US008406982B2

(12) United States Patent
Yamada et al.

(10) Patent No.: US 8,406,982 B2
(45) Date of Patent: Mar. 26, 2013

(54) FUEL INJECTION DETECTING DEVICE

(75) Inventors: Naoyuki Yamada, Kariya (JP); Koji Ishizuka, Chita-gun (JP)

(73) Assignee: Denso Corporation, Kariya (JP)

( * ) Notice: Subject to any disclaimer, the term of this patent is extended or adjusted under 35 U.S.C. 154(b) by 328 days.

(21) Appl. No.: 12/731,401

(22) Filed: Mar. 25, 2010

(65) Prior Publication Data

US 2010/0250095 A1 Sep. 30, 2010

(30) Foreign Application Priority Data

Mar. 25, 2009 (JP) ..... 2009-74283

(51) Int. Cl.
*F02D 41/30* (2006.01)
*F02M 63/00* (2006.01)

(52) U.S. Cl. ..... 701/103; 123/447

(58) Field of Classification Search ..... 701/103–105; 123/299–305, 445–448, 456, 472, 478–481, 123/486, 494, 568.11, 568.26
See application file for complete search history.

(56) References Cited

U.S. PATENT DOCUMENTS

| | | | | |
|---|---|---|---|---|
| 7,000,600 | B1 | 2/2006 | Yamada et al. | |
| 7,677,092 | B2 | 3/2010 | Ishizuka et al. | |
| 7,747,377 | B2 | 6/2010 | Nakata et al. | |
| 7,792,632 | B2 | 9/2010 | Ishizuka et al. | |
| 2002/0092504 | A1 * | 7/2002 | Kohketsu et al. | 123/447 |
| 2003/0159678 | A1 * | 8/2003 | Egler et al. | 123/447 |
| 2006/0005816 | A1 | 1/2006 | Ishizuka et al. | |
| 2008/0228374 | A1 | 9/2008 | Ishizuka et al. | |
| 2009/0056676 | A1 | 3/2009 | Nakata et al. | |
| 2009/0063010 | A1 | 3/2009 | Nakata et al. | |
| 2009/0063011 | A1 | 3/2009 | Nakata et al. | |
| 2009/0063012 | A1 | 3/2009 | Nakata et al. | |
| 2009/0063013 | A1 | 3/2009 | Nakata et al. | |

(Continued)

FOREIGN PATENT DOCUMENTS

| | | | |
|---|---|---|---|
| EP | 1544446 | A2 * | 6/2005 |
| JP | 2000-265892 | | 9/2000 |

(Continued)

OTHER PUBLICATIONS

Chinese Office Action dated Jun. 19, 2012, issued in corresponding Chinese Application No. 201010149193.9 with English Translation.

(Continued)

*Primary Examiner* — John T. Kwon
*Assistant Examiner* — Johnny Hoang
(74) *Attorney, Agent, or Firm* — Nixon & Vanderhye P.C.

(57) ABSTRACT

A fuel injection detecting device computes a maximum-fuel-injection-rate-reach timing and a fuel-injection-rate-decrease-start timing based on a falling waveform of the fuel pressure and a rising waveform of the fuel pressure. The falling waveform represents the fuel pressure detected by a fuel sensor during a period in which the fuel pressure increases due to a fuel injection rate decrease. The rising waveform represents the fuel pressure detected by the fuel sensor during a period in which the fuel pressure decreases due to a fuel injection rate increase. The rising waveform and the falling waveform are respectively modeled by modeling function. In a case of small fuel injection quantity, an intersection timing at which lines expressed by the modeling functions intersect with each other is defined as the maximum-fuel-injection-rate-reach timing and the fuel-injection-rate-decrease-start timing.

24 Claims, 14 Drawing Sheets

U.S. PATENT DOCUMENTS

| | | | | |
|---|---|---|---|---|
| 2009/0063016 | A1 | 3/2009 | Nakata et al. | |
| 2009/0319157 | A1 * | 12/2009 | Ishizuka | 701/106 |
| 2009/0326788 | A1 * | 12/2009 | Yuasa et al. | 701/104 |

FOREIGN PATENT DOCUMENTS

| | | | |
|---|---|---|---|
| JP | 200165397 | A * | 3/2001 |
| JP | 2001-123917 | | 5/2001 |
| JP | 2005-180338 | | 7/2005 |
| JP | 2009-57926 | | 3/2009 |
| JP | 2009-57929 | | 3/2009 |

OTHER PUBLICATIONS

Japanese Office Action dated Jan. 11, 2011, issued in corresponding Japanese Application No. 2009-074283 with English Translation.
U.S. Appl. No. 12/731,412, filed Mar. 25, 2010, Yamada et al.
U.S. Appl. No. 12/731,431, filed Mar. 25, 2010, Yamada et al.
U.S. Appl. No. 12/731,444, filed Mar. 25, 2010, Imai et al.
Office Action (11 pgs.) dated Aug. 14, 2012 issued in co-pending U.S. Appl. No. 12/731,444.

* cited by examiner

DRIVING CURRENT PULSE
Tq
Ie
Is

FUEL INJECTION RATE
R3
R4
R7
R8
Rα
Rβ
Rγ
S(Q)
T11

DETECTION PRESSURE
Pe
Pu(n-1)
Pu(n)
ΔP1
ΔP2
T10
P0
P1
P2
P3
P3a
P4
P5
P6
P7
P7a
P8
P8a
Pα
Pβ
Pγ

FIG. 6A
DRIVING CURRENT PULSE
FIG. 6B
FUEL PRESSURE
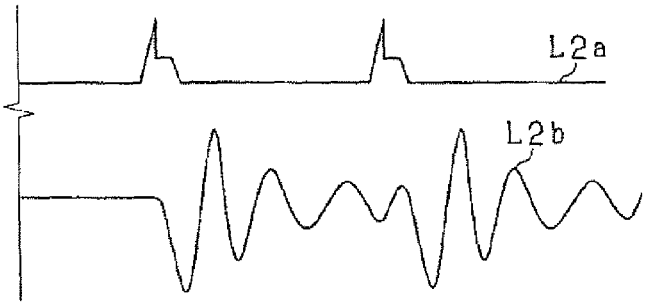
FIG. 7A
DRIVING CURRENT PULSE
FIG. 7B
FUEL PRESSURE
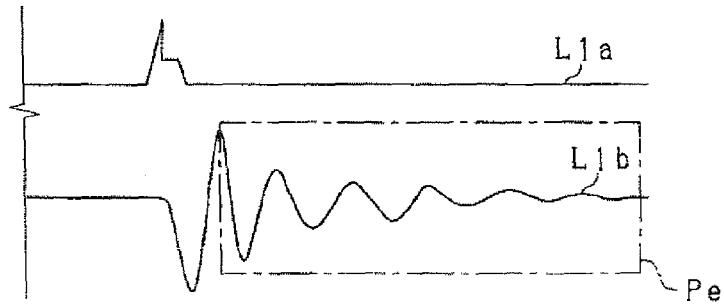
FIG. 8A
DRIVING CURRENT PULSE
FIG. 8B
FUEL PRESSURE
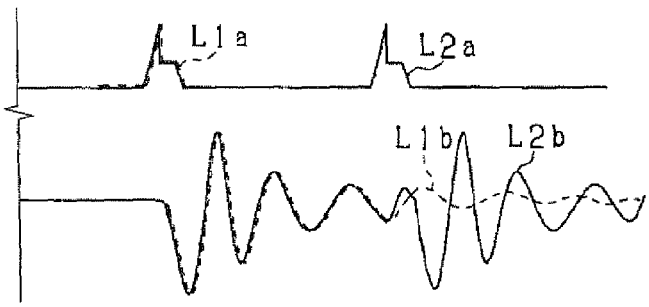
FIG. 9A
DRIVING CURRENT PULSE
FIG. 9B
FUEL PRESSURE
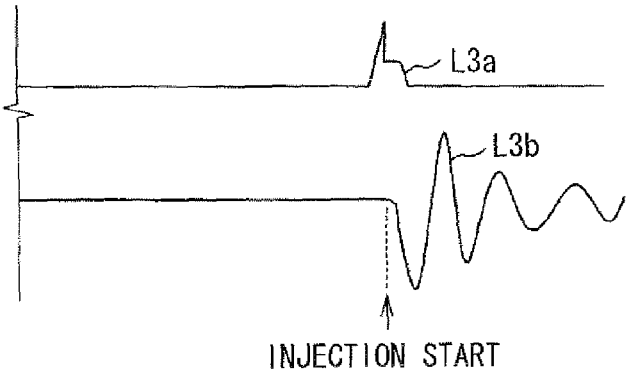

FUEL INJECTION DETECTING DEVICE

CROSS-REFERENCE TO RELATED APPLICATION

This application is based on Japanese Patent Application No. 2009-74283 filed on Mar. 25, 2009, the disclosure of which is incorporated herein by reference.

FIELD OF THE INVENTION

The present invention relates to a fuel injection detecting device which detects fuel injection condition.

BACKGROUND OF THE INVENTION

It is important to detect a fuel injection condition, such as a fuel-injection-start timing, a maximum-fuel-injection-rate-reach timing, a fuel injection quantity and the like in order to accurately control an output torque and an emission of an internal combustion engine. Conventionally, it is known that an actual fuel injection condition is detected by sensing a fuel pressure in a fuel injection system, which is varied due to a fuel injection. For example, JP-2008-144749A (US-2008-0228374A1) describes that an actual fuel-injection-start timing is detected by detecting a timing at which the fuel pressure in the fuel injection system starts to be decreased due to a start of the fuel injection and an actual maximum fuel injection rate is detected by detecting a fuel pressure drop (maximum fuel pressure drop).

A fuel pressure sensor disposed in a common rail hardly detects a variation in the fuel pressure with high accuracy because the fuel pressure variation due to the fuel injection is attenuated in the common rail. JP-2008-144749A and JP-2000-265892A describe that a fuel pressure sensor is disposed in a fuel injector to detect the variation in the fuel pressure before the variation is attenuated in the common rail.

The present inventors has studied a method of computing a timing at which the fuel injection rate becomes a maximum value and a timing at which the fuel injection rate starts to fall from the maximum value based on a pressure waveform detected by the pressure sensor disposed in a fuel injector, which method will be described hereinafter.

As shown in FIG. 19A, when a command signal for starting a fuel injection is outputted from an electronic control unit (ECU) at a fuel-injection-start command timing "Is", a driving current pulse supplied from an electronic driver unit (EDU) to a fuel injector starts to rise at the fuel-injection-start command timing "Is". When a command signal for ending a fuel injection is outputted from the ECU at a fuel-injection-end command timing "Ie", the driving current pulse starts to fall at the fuel-injection-end command timing "Ie". A detection pressure detected by the fuel pressure sensor varies as shown by a solid line "L1" in FIG. 19B.

It should be noted that the command signal for starting a fuel injection is referred to as a SFC-signal and the command signal for ending a fuel injection is referred to as an EFC-signal, hereinafter.

When the SFC-signal is outputted from the ECU at the fuel-injection-start command timing "Is" and a fuel injection rate (fuel injection quantity per unit time) increases, the detection pressure starts to decrease at a changing point "P3*b*" on the pressure waveform. Then, when the fuel injection rate becomes a maximum value, a decrease in the detection pressure ends at a changing point "P4*b*" on the pressure waveform.

It should be noted that since the fuel flows toward an injection port by its inertia even after a timing of the maximum fuel injection rate, the detection pressure starts to increase after the decrease in the detection pressure ends at the changing point "P4*b*".

Then, when the EFC-signal is outputted at the fuel-injection-end command timing "Ie" and the fuel injection rate starts to decrease, the detection pressure starts to increase steeply at a changing point "P7*b*" on the pressure waveform. Then, when the fuel injection ends and the fuel injection rate becomes zero, the increase in the detection pressure ends at a changing point "P8*b*" on the pressure waveform.

Timings "t31" and "t32" at which the changing points "P4*b*" and "P7*b*" respectively appears are detected as a maximum-fuel-injection-rate-reach timing and a fuel-injection-rate-decrease-start timing, respectively. It should be noted that the maximum-fuel-injection-rate-reach timing is a timing at which the fuel injection rate becomes a maximum value, which is referred to as MFIRR timing, hereinafter. The fuel-injection-rate-decrease-start timing is a timing at which the fuel injection rate starts to fall, which is referred to as FIRDS timing, hereinafter.

Specifically, as shown by a solid line M1 in FIG. 19C, differential values are computed with respect to every detection pressure. After the SFC-signal is outputted and the detection pressure starts to decrease, the differential value first becomes zero at a timing "t31". This timing "t31" is detected as the MFIRR timing at which the changing point "P4*b*" appears. Further, after the changing point "P4*b*", the differential value first exceeds a threshold TH at a timing "t32". This timing "t32" is detected as the FIRDS timing at which the changing point "P7*b*" appears.

In a case that a multi-stage injection is performed during one combustion cycle, a pressure pulsation is generated on the pressure waveform due to an overlapping of an aftermath (refer to an encircled portion "A0" in FIG. 19B) of a previous waveform with a current waveform. Also, a pulsation is generated in a waveform of the differential value of the detection pressure. Thus, according to the above described computing method, the MFIRR timing and the FIRDS timing can not be accurately computed. Especially, in a case that a multi-stage injection is performed, when an interval between n-th injection and (n+1)th injection is short, an unstable pressure waveform of n-th fuel injection overlaps with the pressure waveform of (n+1)th fuel injection. The pulsations of the pressure waveform and the differential value become large and an erroneous detection of the MFIRR timing and the FIRDS timing may be caused.

Moreover, it is conceivable that noises overlapping on the pressure waveform may cause a disturbance of the pressure waveform. Thus, even in a case that single-stage injection is performed or the interval is long, the above mentioned erroneous detection may be performed.

The present invention is made in view of the above matters, and it is an object of the present invention to provide a fuel injection detecting device capable of detecting a maximum-fuel-injection-rate-reach (MFIRR) timing and/or a fuel-injection-rate-decrease-start (FIRDS) timing with high accuracy based on a pressure waveform detected by a fuel pressure sensor.

According to the present invention, a fuel injection detecting device detecting a fuel injection condition is applied to a fuel injection system in which a fuel injector injects a fuel accumulated in an accumulator. The fuel injection detecting device includes a fuel pressure sensor provided in a fuel passage fluidly connecting the accumulator and a fuel injection port of the fuel injector. The fuel pressure sensor detects a fuel pressure which varies due to a fuel injection from the fuel injection port. Further, the fuel injection detecting device includes a changing point computing means for computing a changing timing, which is at least one of a fuel-injection-rate-decrease-start timing and a maximum-fuel-injection-rate-reach timing, based on a falling waveform of the fuel pressure during a period in which the fuel pressure decreases due to a fuel injection rate increase and a rising waveform of the fuel pressure during a period in which the fuel pressure increases due to the fuel injection rate decrease.

The fuel-injection-rate-decrease-start timing represents a timing at which the fuel injection rate starts to fall from a maximum fuel injection rate. The maximum-fuel-injection-rate-reach timing represents a timing at which the fuel injection rate becomes the maximum fuel injection rate.

When a command signal for starting a fuel injection is outputted, a fuel injection rate (fuel injection quantity per a unit time) starts to increase and the detection pressure detected by the fuel sensor starts to increase. After that, when a command signal for ending a fuel injection is outputted, a fuel injection rate starts to decrease and the detection pressure detected by the fuel sensor starts to increase. A falling pressure waveform and a rising pressure waveform hardly receive disturbances and their shapes are stable. Further, the falling waveform and rising waveform have high correlationship with the fuel-injection-rate-decrease-start timing and the maximum-fuel-injection-rate-reach timing.

According to the present invention, since the changing timing is computed based on the falling waveform and the rising waveform, the changing timing can be accurately computed without receiving any disturbances.

According to another aspect of the present invention, a fuel injection detecting device includes an intersection timing computing means for computing an intersection timing at which a first line expressed by the falling-modeling function and a second line expressed by the rising-modeling function intersect with each other;

an intersection pressure computing means for computing an intersection pressure at which a first line expressed by the falling-modeling function and a second line expressed by the rising-modeling function intersect with each other;

a reference pressure computing means for computing a reference pressure based on a fuel pressure right before the falling waveform is generated;

a determination means for determining whether a pressure difference between the reference pressure and the intersection pressure is greater than a predetermined value; and a changing point computing means for computing both a maximum-fuel-injection-rate-reach timing at which an output of the falling-modeling function is the predetermined value and a fuel-injection-rate-decrease-start timing at which an output of the rising-modeling function is the predetermined value, in a case that the difference between the reference pressure and the intersection pressure is greater than the predetermined value.

BRIEF DESCRIPTION OF THE DRAWINGS

Other objects, features and advantages of the present invention will become more apparent from the following description made with reference to the accompanying drawings, in which like parts are designated by like reference numbers and in which:

FIGS. 6A and 6B are time charts showing a fuel injection characteristic according to the first embodiment;

FIGS. 7A and 7B are time charts showing a fuel injection characteristic according to the first embodiment;

FIGS. 8A and 8B are time charts showing a fuel injection characteristic according to the first embodiment, wherein solid lines show waveforms shown in FIGS. 6A and 6B and dashed lines show waveforms shown in FIGS. 7A and 78;

FIGS. 9A and 9B are time charts showing waveforms which are obtained by subtracting the waveforms shown in FIGS. 7A and 7B from waveforms shown in FIGS. 6A and 68;

DETAILED DESCRIPTION OF EMBODIMENTS

Hereafter, embodiments of the present invention will be described.

First Embodiment

First, it is described about an internal combustion engine to which a fuel injection detecting device is applied. The internal combustion engine is a multi-cylinder four stroke diesel engine which directly injects high pressure fuel (for example, light oil of 1000 atmospheres) to a combustion chamber.

Figure 1:
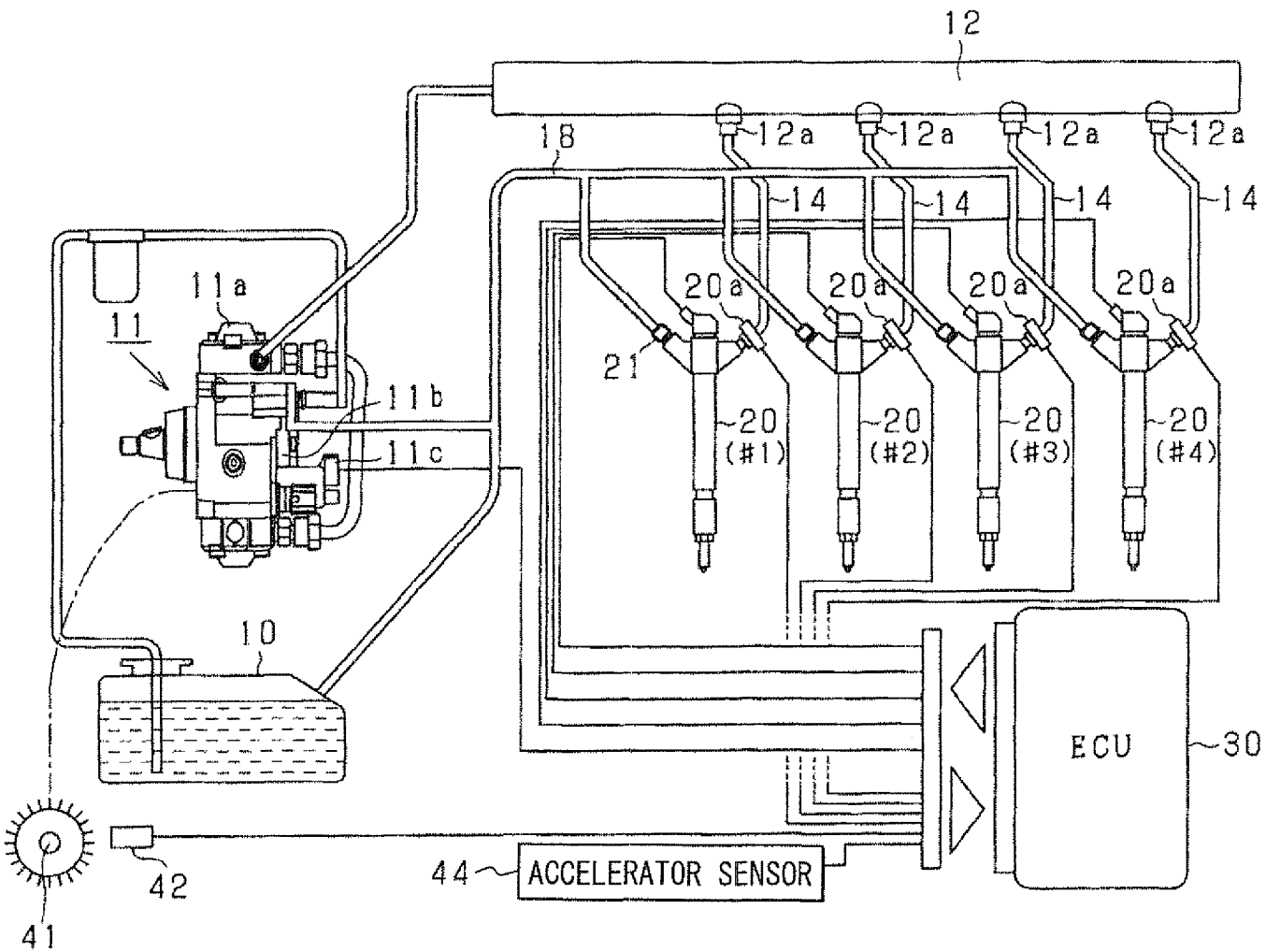
FIG. 1 is a construction diagram showing an outline of a fuel injection system on which a fuel injection detecting device is mounted, according to a first embodiment of the present invention.

FIG. 1 is a construction diagram showing an outline of a common rail fuel injection system according to an embodiment of the present invention. An electronic control unit (ECU) 30 feedback controls a fuel pressure in a common rail 12 in such a manner as to agree with a target fuel pressure. The fuel pressure in the common rail 12 is detected by a fuel pressure sensor 20*a* and controlled by adjusting an electric current supplied to a suction control valve 11*c*. Further, based on the fuel pressure, a fuel injection quantity of each cylinder and an output of the engine are controlled.

The various devices constructing the fuel supply system include a fuel tank 10, a fuel pump 11, the common rail 12, and injectors 20 which are arranged in this order from the upstream side of fuel flow. The fuel pump 11, which is driven by the engine, includes a high-pressure pump 11*a* and a low-pressure pump 11*b*. The low-pressure pump 11*b* suctions the fuel in the fuel tank 10, and the high-pressure pump 11*a* pressurizes the suctioned fuel. The quantity of fuel pressure-fed to the high-pressure pump 11*a*, that is, the quantity of fuel discharged from the fuel pump 11 is controlled by the suction control valve (SCV) 11*c* disposed on the fuel suction side of the fuel pump 11. That is, the fuel quantity discharged from the fuel pump 11 is controlled to a desired value by adjusting a driving current supplied to the SCV 11*c*.

The low-pressure pump 11*b* is a trochoid feed pump. The high-pressure pump 11*a* is a plunger pump having three plungers. Each plunger is reciprocated in its axial direction by an eccentric cam (not shown) to pump the fuel in a pressuring chamber at specified timing sequentially.

The pressurized fuel by the fuel pump 11 is introduced into the common rail 12 to be accumulated therein. Then, the accumulated fuel is distributed to each injector 20 mounted in each cylinder #1-#4 through a high-pressure pipe 14. A fuel discharge port 21 of each injector 20 is connected to a low-pressure pipe 18 for returning excessive fuel to the fuel tank 10. Moreover, between the common-rail 12 and the high-pressure pipe 14, there is provided an orifice 12*a* (fuel pulsation reducing means) which attenuates pressure pulsation of the fuel which flows into the high-pressure pipe 14 from the common rail 12.

Figure 2:
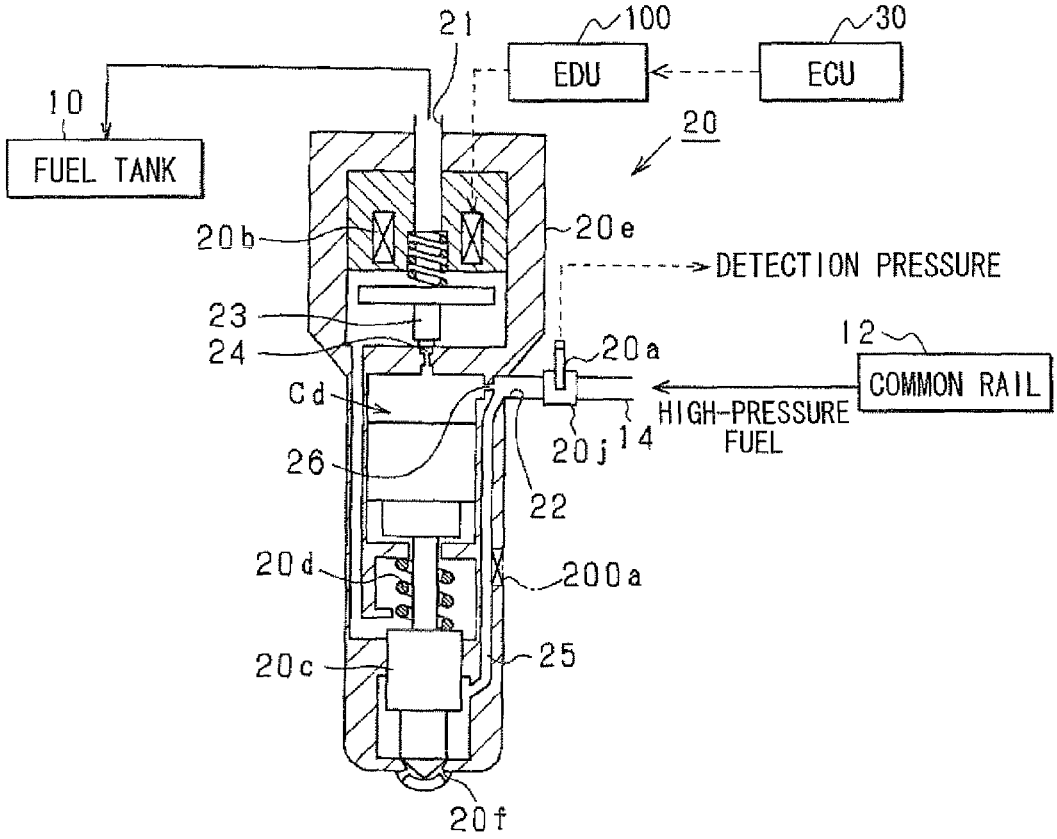
FIG. 2 is a cross-sectional view schematically showing an internal structure of an injector.

The structure of the injector 20 will be described in detail with reference to FIG. 2. The above four injectors 20 (#1-#4) have fundamentally same structure. The injector 20 is a hydraulic injection valve using the fuel (fuel in the fuel tank 10), and a driving force for fuel injection is transferred to the valve portion through a backpressure chamber Cd. As shown in FIG. 2, the injector 20 is a normally-closed valve.

A housing 20*e* of the injector 20 has a fuel inlet 22 through which the fuel flows from the common rail 12. A part of the fuel flows into the backpressure chamber Cd through an inlet orifice 26 and the other flows toward a fuel injection port 20*f*. The backpressure chamber Cd is provided with a leak hole (orifice) 24 which is opened/closed by a control valve 23. When the leak hole 24 is opened, the fuel in the backpressure chamber Cd is returned to the fuel tank 10 through the leak hole 24 and a fuel discharge port 21.

When a solenoid 20*b* is energized, the control valve 23 is lifted up to open the leak hole 24. When the solenoid 20*b* is deenergized, the control valve 23 is lifted down to close the leak hole 24. According to the energization/deenergization of the solenoid 20*b*, the pressure in the backpressure chamber Cd is controlled. The pressure in the backpressure chamber Cd corresponds to a backpressure of a needle valve 20*c*. A needle valve 20*c* is lifted up or lifted down according to the pressure in the oil pressure chamber Cd, receiving a biasing force from a spring 20*d*. When the needle valve 20*c* is lifted up, the fuel flows through a high-pressure passage 25 and is injected into the combustion chamber through the injection port 20*f*.

The needle valve 20*c* is driven by an ON-OFF control. That is, when the ECU 30 outputs the SFC-signal to an electronic driver unit (EDU) 100, the EDU 100 supplies a driving current pulse to the solenoid 20*b* to lift up the control valve 23. When the solenoid 20*b* receives the driving current pulse, the control valve 23 and the needle valve 20*c* are lifted up so that the injection port 20*f* is opened. When the solenoid 20*b* receives no driving current pulse, the control valve 23 and the needle valve 20*c* are lifted down so that the injection port 20*f* is closed.

The pressure in the backpressure chamber Cd is increased by supplying the fuel in the common rail 12. On the other hand, the pressure in the backpressure chamber Cd is decreased by energizing the solenoid 20*b* to lift up the control valve 23 so that the leak hole 24 is opened. That is, the fuel pressure in the backpressure chamber Cd is adjusted by the control valve 23, whereby the operation of the needle valve 20*c* is controlled to open/close the fuel injection port 20*f*.

As described above, the injector 20 is provided with a needle valve 20*c* which opens/closes the fuel injection port 20*f*. The needle valve 20*c* has a sealing surface 20*g* and the housing 20*e* has a seat surface 20*h*. When the sealing surface 20*g* is seated on the seat surface 20*h*, the high-pressure passage 25 is closed. When the sealing surface 20*g* is unseated from the seat surface 20*h*, the high-pressure passage 25 is opened.

When the solenoid 20*b* is deenergized, the needle valve 20*c* is moved to a closed-position by a biasing force of the spring 20*d*. When the solenoid 20*b* is energized, the needle valve 20*c* is moved to an open-position against the biasing force of the spring 20*d*.

A fuel pressure sensor 20*a* is disposed at a vicinity of the fuel inlet 22. Specifically, the fuel inlet 22 and the high-pressure pipe 14 are connected with each other by a connector 20*j* in which the fuel pressure sensor 20*a* is disposed. The fuel pressure sensor 20*a* detects fuel pressure at the fuel inlet 22 at any time. Specifically, the fuel pressure sensor 20*a* can detect a fuel pressure level (stable pressure), a fuel injection pressure, a variation in a waveform of the fuel pressure due to the fuel injection, and the like.

The fuel pressure sensor 20*a* is provided to each of the injectors 20. Based on the outputs of the fuel pressure sensor 20*a*, the variation in the waveform of the fuel pressure due to the fuel injection can be detected with high accuracy.

A microcomputer of the ECU 30 includes a central processing unit (CPU), a random access memory (RAM), a read only memory (ROM), an electrically erasable programmable read-only memory (EEPROM), a backup RAM, and the like. The ROM stores a various kind of programs for controlling the engine, and the EEPROM stores a various kind of data such as design date of the engine.

Moreover, the ECU 30 computes a rotational position of a crankshaft 41 and a rotational speed of the crankshaft 41, which corresponds to engine speed NE, based on detection signals from a crank angle sensor 42. A position of an accelerator is detected based on detection signals from an accelerator sensor 44. The ECU 30 detects the operating state of the engine and user's request on the basis of the detection signals of various sensors and operates various actuators such as the injector 20 and the SCV 11*c*.

Hereinafter, a control of fuel injection executed by the ECU 30 will be described.

The ECU 30 computes the fuel injection quantity according to an engine driving condition and the accelerator operation amount. The ECU 30 outputs the SFC-signal and the EFC-signal to the EDU 100. When the EDU 100 receives the SFC-signal, the EDU 100 supplies the driving current pulse to the injector 20. When the EDU 100 receives the EFC-signal, the EDU 100 stops a supply of the driving current pulse to the injector 20. The injector 20 injects the fuel according to the driving current pulse.

Figure 3:
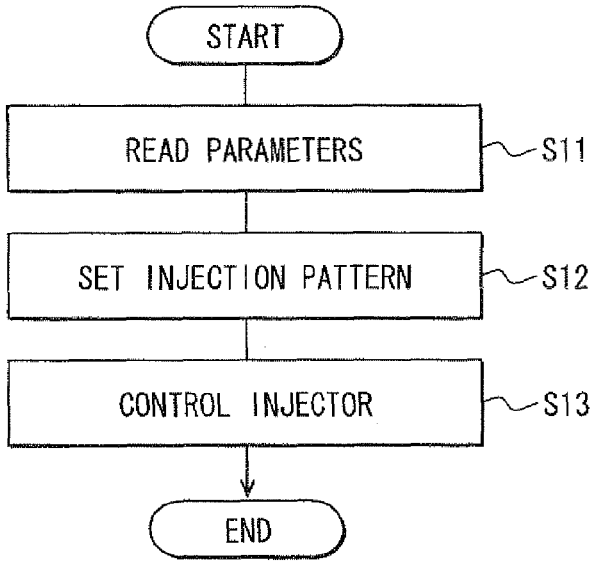
FIG. 3 is a flowchart showing a basic procedure of a fuel injection control.

Hereinafter, the basic procedure of the fuel injection control according to this embodiment will be described with reference to FIG. 3. The values of various parameters used in this processing shown in FIG. 3 are stored in the storage devices such as the RAM, the EEPROM, or the backup RAM mounted in the ECU 30 and are updated at any time as required.

In step S11, the computer reads specified parameters, such as the engine speed measured by the crank angle sensor 42, the fuel pressure detected by the fuel pressure sensor 20*a*, and the accelerator position detected by the accelerator sensor 44.

In step S12, the computer sets the injection pattern based on the parameters which are read in step S11. In a case of a single-stage injection, a fuel injection quantity (fuel injection period) is determined to generate the required torque on the crankshaft 41. In a case of a multi-stage injection, a total fuel injection quantity (total fuel injection period) is determined to generate the required torque on the crankshaft 41.

The injection pattern is obtained based on a specified map and a correction coefficient stored in the ROM. Specifically, an optimum injection pattern is obtained by an experiment with respect to the specified parameter. The optimum injection pattern is stored in an injection control map.

This injection pattern is determined by parameters such as a number of fuel injection per one combustion cycle, a fuel injection timing and fuel injection period of each fuel injection. The injection control map indicates a relationship between the parameters and the optimum injection pattern.

The injection pattern is corrected by the correction coefficient which is updated and stored in the EEPROM, and then the driving current pulse to the injector 20 is obtained according the corrected injection pattern. The correction coefficient is sequentially updated during the engine operation.

Then, the procedure proceeds to step S13. In step S13, the injector 20 is controlled based on the driving current pulse supplied from the EDU 100. Then, the procedure is terminated.

Figure 4:
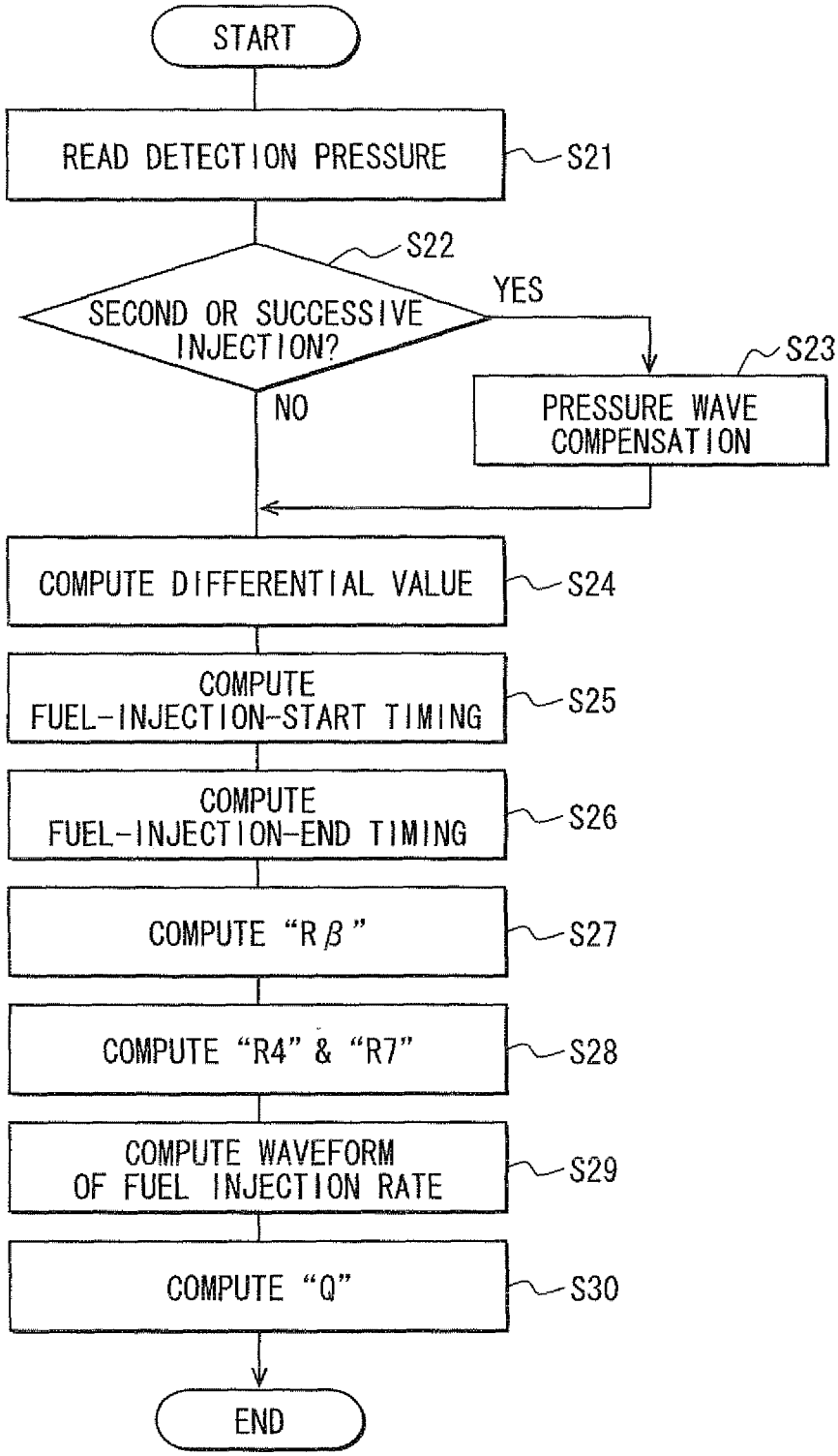
FIG. 4 is a flowchart showing a procedure for detecting a fuel injection condition based on a detection pressure detected by a fuel pressure sensor.

Referring to FIG. 4, a processing for detecting (computing) an actual fuel injection condition will be described.

The processing shown in FIG. 4 is performed at a specified cycle (for example, a computation cycle of the CPU) or at every specified crank angle. In step S21, an output value (detection pressure) of each fuel pressure sensor 20*a* is read. It is preferable that the output value is filtered to remove noises therefrom.

Figures 5A, 5B, 5C:
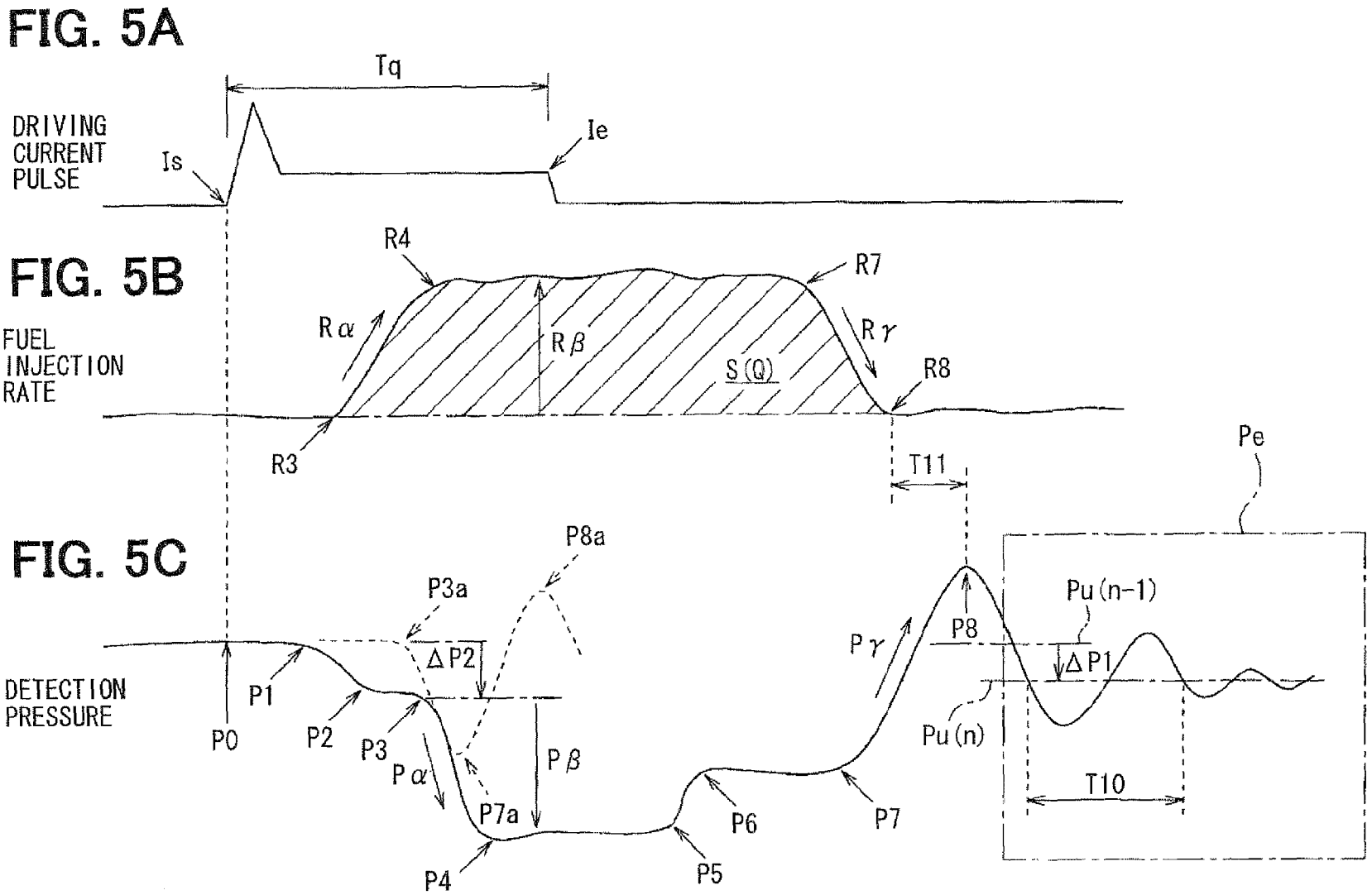
FIGS. 5A to 5C are time charts showing a relationship between a waveform of detection pressure detected by the fuel pressure sensor and a waveform of injection rate in a case of a single-stage injection.

Referring to FIGS. 5A to 5C, the processing in step S21 will be described in detail.

FIG. 5A shows the driving current pulse which the injector 20 receives from the EDU 100 in step S13. When the driving current pulse is supplied to the injector 20, the solenoid 20*b* is energized to open the injection port 20*f*. That is, the ECU 30 outputs the SFC-signal to start the fuel injection at the fuel-injection-start command timing "Is", and the ECU 30 outputs the EFC-signal to stop the fuel injection at the fuel-injection-end command timing "Ie". During a time period "Tq" from the timing "Is" to the timing "Ie", the injection port 20*f* is opened. By controlling the time period "Tq", the fuel injection quantity "Q" is controlled. FIG. 5B shows a variation in fuel injection rate, and FIG. 5C shows a variation in detection pressure detected by the fuel pressure sensor 20*a*. It should be noted that FIGS. 5A to 5C show a case in which the injection port 20*f* is opened and close only once.

The ECU 30 detects the output value of the fuel pressure sensor 20*a* by a sub-routine (not shown). In this sub-routine, the output value of the fuel pressure sensor 20*a* is detected at a short interval so that a pressure waveform can be drawn. Specifically, the sensor output is successively acquired at an interval shorter than 50 μsec (desirably 20 μsec).

Since the variation in the detection pressure detected by the fuel pressure sensor 20*a* and the variation in the fuel injection rate have a relationship described below, a waveform of the fuel injection rate can be estimated based on a waveform of the detection pressure.

After the solenoid 20*b* is energized at the fuel-injection-start command timing "Is" to start the fuel injection from the injection port 20*f*, the fuel injection rate starts to increase at a changing point "R3" as shown in FIG. 5B. That is, an actual fuel injection is started. Then, the fuel injection rate reaches the maximum injection rate at a changing point "R4". In other wards, the needle valve 20*c* starts to be lifted up at the changing point "R3" and the lift-up amount of the needle valve 20*c* becomes maximum at the changing point "R4".

It should be noted that the "changing point" is defined as follows in the present application. That is, a second order differential of the fuel injection rate (or a second order differential of the detection pressure detected by the fuel pressure sensor 20*a*) is computed. The changing point corresponds to an extreme value in a waveform representing a variation in the second order differential. That is, the changing point of the fuel injection rate (detection pressure) corresponds to an inflection point in a waveform representing the second order differential of the fuel injection rate (detection pressure).

Then, after the solenoid 20*b* is deenergized at the fuel-injection-end command timing "Ie", the fuel injection rate starts to decrease at a changing point "R7". Then, the fuel injection rate becomes zero at a changing point "R8" and the actual fuel injection is terminated. In other wards, the needle valve 20*c* starts to be lifted down at the changing point "R7" and the injection port 20*f* is sealed by the needle valve 20*c* at the changing point "R8".

Referring to FIG. 5C, a variation in the detection pressure detected by the fuel pressure sensor 20*a* will be described. Before the fuel-injection-start command timing "Is", the detection pressure is denoted by "P0". After the pulse driving current is applied to the solenoid 20*b*, the detection pressure starts to decrease at a changing point "P1" before the fuel injection rate start to increase at the changing point "R3". This is because the control valve 23 opens the leak hole 24 and the pressure in the backpressure chamber Cd is decreased at the changing point "P1". When the pressure in the backpressure chamber Cd is decreased enough, the detection pressure drop is stopped at a changing point "P2". It is due to that the leak hole 24 is fully opened and the leak quantity becomes constant, depending on an inner diameter of the leak hole 24.

Then, when the fuel injection rate starts to increase at the changing point "R3", the detection pressure starts to decrease at a changing point "P3". When the fuel injection rate reaches the maximum injection rate at a changing point "R4", the detection pressure drop is stopped at a changing point "P4". It should be noted that the pressure drop from the changing point "P3" to the changing point "P4" is greater than that from the changing point "P1" to the changing point "P2".

Then, the detection pressure starts to increase at a changing point "P5". It is due to that the control valve 23 seals the leak hole 24 and the pressure in the backpressure chamber Cd is increased at the point "P5". When the pressure in the backpressure chamber Cd is increased enough, an increase in the detection pressure is stopped at a changing point "P6".

When the fuel injection rate starts to decrease at a changing point "R7", the detection pressure starts to increase at a changing point "P7". Then, when the fuel injection rate becomes zero and the actual fuel injection is terminated at a changing point "R8", the increase in the detection pressure is stopped at a changing point "P8". It should be noted that the pressure increase amount from the changing point "P7" to the changing point "P8" is greater than that from the changing point "P5" to the changing point "P6". After the changing point "P8", the detection pressure is attenuated at a specified period T10.

As described above, by detecting the changing points "P3", "P4", "P7" and "P8" in the detection pressure, the starting point "R3" of the fuel injection rate increase (an actual fuel-injection-start timing), the maximum-fuel-injection-rate-reach point "R4" (MFIRR timing), the fuel-injection-rate-decrease-start point "R7" (FIRDS timing), and the ending point "R8" of the fuel injection rate decrease (the actual fuel-injection-end timing) can be estimated. Based on a relationship between the variation in the detection pressure and the variation in the fuel injection rate, which will be described below, the variation in the fuel injection rate can be estimated from the variation in the detection pressure.

That is, a decreasing rate "Pα" of the detection pressure from the changing point "P3" to the changing point "P4" has a correlation with an increasing rate "Rα" of the fuel injection rate from the changing point "R3" to the changing point "R4". An increasing rate "Pγ" of the detection pressure from the changing point "P7" to the changing point "P8" has a correlation with a decreasing rate "Rγ" of the fuel injection rate from the changing point "R7" to the point "R8" A decreasing amount of the detection pressure from the changing point "P3" to the changing point "P4" (maximum fuel pressure drop "Pβ") has a correlation with an increasing amount "Rβ" of the fuel injection rate from the changing point "R3" to the changing point "R4" (maximum fuel injection rate).

Therefore, the increasing rate "Rα" of the fuel injection rate, the decreasing rate "Rγ" of the fuel injection rate, and the maximum injection rate "Rβ" can be estimated by detecting the decreasing rate "Pα" of the detection pressure, the increasing rate "Pγ" of the detection pressure, and the maximum pressure drop "Pβ" of the detection pressure. The variation in the fuel injection rate (variation waveform) shown in FIG. 5B can be estimated by estimating the changing points "R3", "R4", "R7", "R8", the increasing rate "Rα" of the fuel injection rate, the maximum injection rate "Rβ" and the decreasing rate "Rγ" of the fuel injection rate.

Furthermore, a value of integral "S" of the fuel injection rate from the actual fuel-injection start-timing to the actual fuel-injection-end timing (shaded area in FIG. 58) is equivalent to the injection quantity "Q". A value of integral of the detection pressure from the actual fuel-injection-start timing to the actual fuel-injection-end timing has a correlation with the value of integral "S" of the fuel injection rate. Thus, the value of integral "S" of the fuel injection rate, which corresponds to the injection quantity "Q", can be estimated by computing the value of integral of detection pressure detected by the fuel pressure sensor 20*a*. As described above, the fuel pressure sensor 20*a* can be operated as an injection quantity sensor which detects a physical quantity relating to the fuel injection quantity.

Referring back to FIG. 4, in step S22, the computer determines whether the current fuel injection is the second or the successive fuel injection. When the answer is Yes in step S22, the procedure proceeds to step S23 in which a pressure wave compensation process is performed with respect to the waveform of detection pressure obtained in step S21. The pressure wave compensation process will be described hereinafter.

FIGS. 6A, 7A, 8A and 9A are timing chart showing driving current pulses to the injector 20. FIGS. 6B, 7B, 8B, and 9B are timing chart showing waveforms of detection pressure.

In a case that the multi-stage injection is performed, following matters should be noted. The pressure waveform generated by n-th (n≧2) fuel injection is overlapped with the pressure waveform generated after the m-th (n>m) fuel injection is terminated. This overlapping pressure waveform generated after m-th fuel injection is terminated is encircled by an alternate long and short dash line Pe in FIG. 5C. In the present embodiment, m-th fuel injection is the first fuel injection.

More specifically, in a case that two fuel injections are performed during one combustion cycle, the driving current pulses are generated as indicated by a solid line L2*a* in FIG. 6A and the pressure waveform is generated as indicated by a solid line L2*b* in FIG. 6B. At a vicinity of fuel-injection-start timing of the latter fuel injection, the pressure waveform generated by the former fuel injection (first fuel injection) interferes with the pressure waveform generated by the latter fuel injection (second fuel injection). It is hard to recognize the pressure waveform which is generated by only the latter fuel injection.

In a case that a single fuel injection (first fuel injection) is performed during one combustion cycle, the driving current pulse is generated as indicated by a solid line L1*a* in FIG. 7A and the pressure waveform is generated as indicated by a solid line L1*b* in FIG. 7B. FIGS. 8A and 8B are time charts in which the timing charts (solid lines L2*a*, L2*b*) shown, in FIGS. 6A and 6B and the timing charts (dashed lines L1*a*, L1*b*) shown in FIGS. 7A and 7B are overlapped with each other. Then, a driving current pulse L3*a* and a pressure waveform L3*b* generated by only the latter fuel injection (second fuel injection), which are shown in FIGS. 9A and 9B, can be obtained by subtracting the driving current pulse L1*a* and the pressure waveform L1*b* from the driving current pulse L2*a* and the pressure waveform L2*b* respectively.

The above described process in which the pressure waveform L1*b* is subtracted from the pressure waveform L2*b* to obtain the pressure waveform L3*b* is performed in step S23. Such a process is referred to as the pressure wave compensation process.

Figures 10A, 10B, 10C:
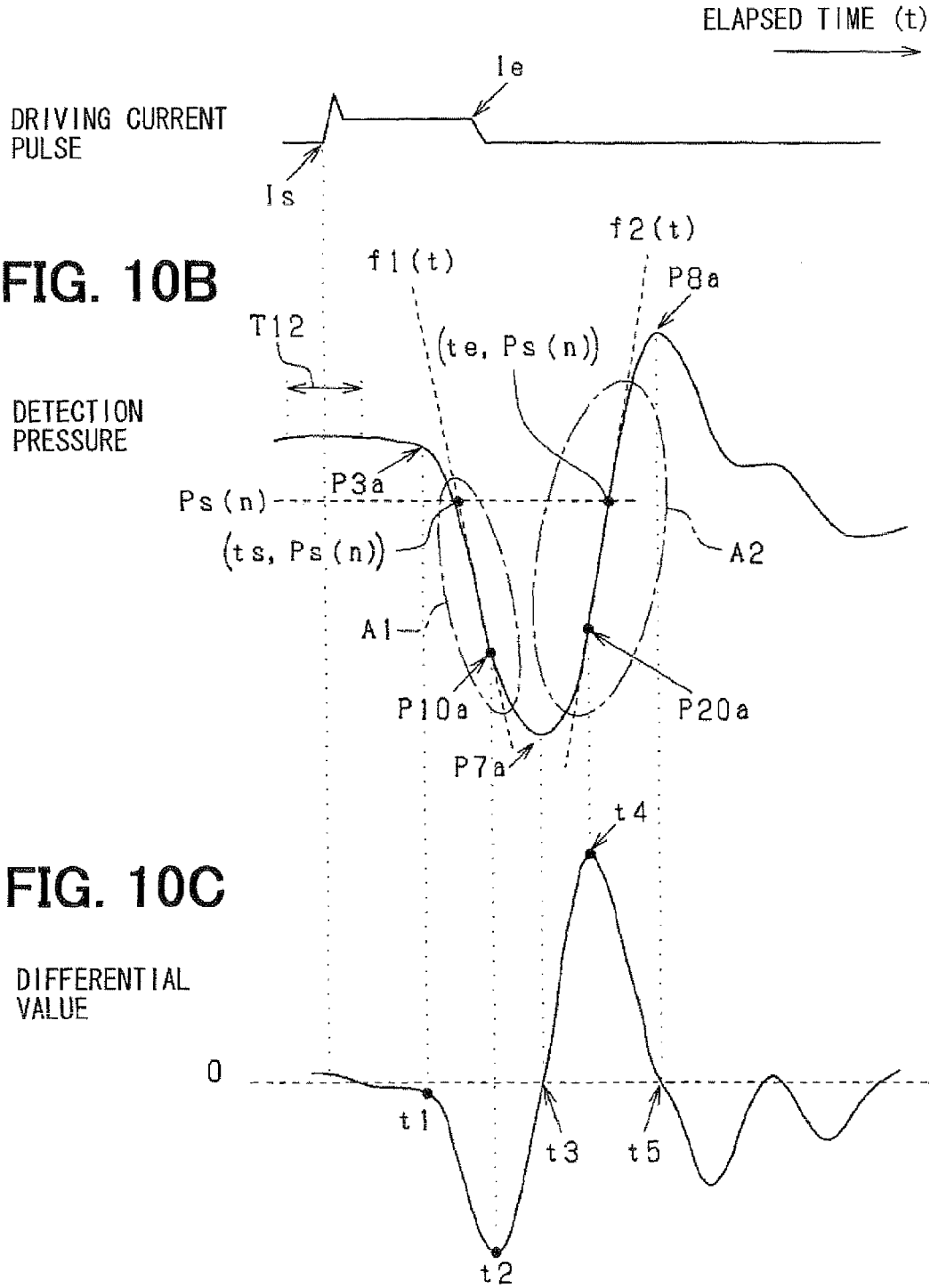
FIGS. 10A to 10C are timing charts for explaining a computing method of a falling-modeling function and a rising-modeling function.

In step S24, the detection pressure (pressure waveform) is differentiated to obtain a waveform of differential value of the detection pressure, which is shown in FIG. 10C.

FIG. 10A shows a driving current pulse in which the SEC-signal is outputted at the fuel-injection-start command timing "Is". FIG. 10B shows a waveform of the detection pressure detected by the fuel pressure sensor 20*a*.

It should be noted that the fuel injection quantity in a case shown in FIGS. 10A to 10C is smaller than that in a case shown in FIGS. 5A to 5B. The pressure waveform shown in FIG. 10B is illustrated by a broken line in FIG. 5C. Thus, the changing points "P4", "P5", "P6" shown in FIG. 5C do not appear in FIG. 10B. Furthermore, FIG. 10B shows the waveform of the detection pressure in which the pressure wave compensation process and the filtering processes have been already performed. Thus, the changing points "P1" and "P2" shown in FIG. 5C are disappeared in FIG. 10B.

A changing point "P3*a*" in FIG. 10B corresponds to the changing point "P3" in FIG. 5C. At the changing point "P3*a*", the detection pressure starts to decrease due to the fuel injection rate increase. A changing point "P7*a*" in FIG. 10B corresponds to the changing point "P7" in FIG. 5C. At the changing point "P7*a*", the detection pressure starts to increase due to the fuel injection rate decrease. A changing point "P8*a*" in FIG. 10B corresponds to the changing point "P8" in FIG. 5C. At the changing point "P8*a*", the detection pressure increase is terminated due to the termination of the fuel injection.

FIG. 10C shows a waveform of differential value of the detection pressure in a case that the fuel injection quantity is small.

Referring back to FIG. 4, in steps S25 to S28, the various injection condition values shown in FIG. 5B are computed based on the differential value of the detection pressure obtained in step S24. That is, a fuel-injection-start timing "R3" is computed in step S25, a fuel-injection-end timing "R8" is computed in step S26, the maximum fuel injection rate "Rβ" is computed in step S27, and a maximum-injection-rate-reach (MFIRR) timing "R4" and a fuel-injection-rate-decrease-start (FIRDS) timing "R7" are computed in step S28. In a case that the fuel injection quantity is small, the MFIRR timing "R4" may agree with the FIRDS timing "R7".

In step S29, the computer computes the waveform of the fuel injection rate from the actual fuel-injection-start timing to the actual fuel-injection-end timing based on the above injection condition values "R3", "R8", "Rβ", "R4", "R7". In step S30, the computer computes the value of integral "S" of the fuel injection rate from the actual fuel-injection-start timing to the actual fuel-injection-end timing based on the waveform of the fuel injection rate. The value of integral "S" is defined as the fuel injection quantity "Q".

It should be noted that the waveform of the fuel injection rate and the value of integral "S" (fuel injection quantity "Q") may be computed based on the increasing rate "Rα" of the fuel injection rate and the decreasing rate "Rγ" of the fuel injection rate in addition to the above injection condition values "R3" "R8", "Rβ", "R4", "R7".

Referring to FIGS. 10 to 17, the computing processes in step S25 to S30 will be described hereinafter.

<Step S25: Computation of Fuel-Injection-Start Timing>

Figure 11:
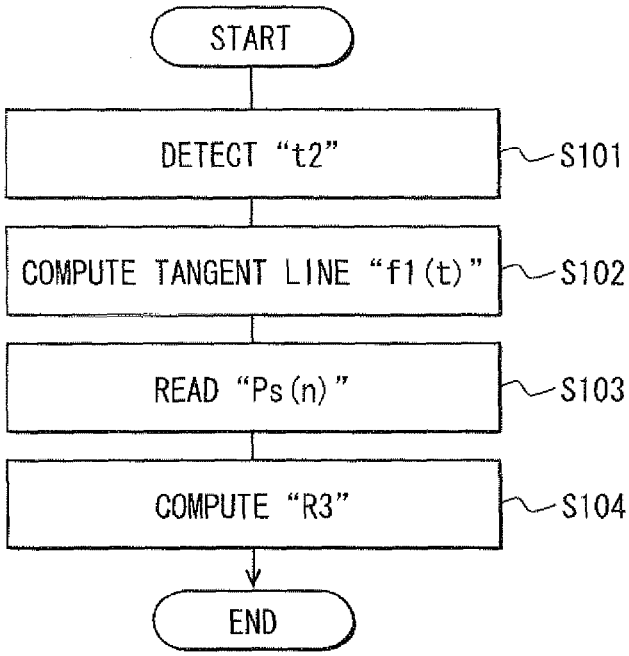
FIG. 11 is a flowchart showing a processing for computing the fuel-injection-start timing.
Figure 12:
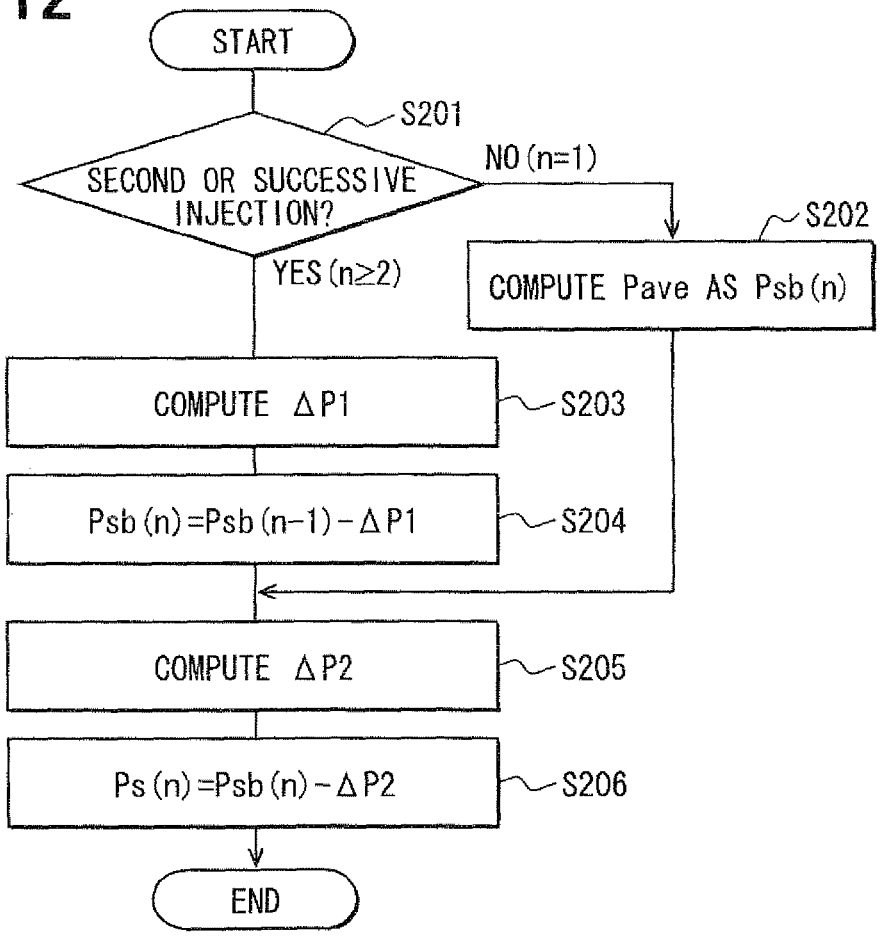
FIG. 12 is a flowchart showing a processing for computing a reference pressure.

FIG. 11 is a flowchart showing a process in step S25 for computing a fuel-injection-start timing "R3". In steps S101 and S102, the pressure waveform in which the detection pressure is decreasing is modeled by a function. This falling waveform is encircled by an alternate long and short dash line A1 in FIG. 10B. The process in step S25 corresponds to a fuel-injection-start timing computing means, and the processes in steps S101 and S102 correspond to a falling waveform modeling means in the present invention.

Referring to FIG. 10C, in step S101, the computer detects a timing "t2" at which the differential value computed in step S24 becomes minimum after the fuel-injection-start command timing "Is". The detection pressure corresponding to the timing "t2" is denoted by "P10*a*" on the pressure waveform.

In step S102, a tangent line of the falling waveform A1 at the point "P10*a*" is expressed by a first function f1(*t*) of an elapsed time "t". This first function f1(*t*) corresponds to a falling-modeling function. This first function f1(*t*) is a linear function, which is shown by a dot-line f1(*t*) in FIG. 10B.

In step S103, a reference pressure Ps(n) is read. This reference pressure Ps(n) is computed according to a flowchart shown in FIG. 12. A processing shown in FIG. 12 corresponds to a reference pressure computing means for computing a reference pressure Ps(n) according to a number of fuel injection stage. It should be noted that the above "n" represents the number of injection stages in the multi-stage injection.

In step S201, the computer determines whether the current fuel injection is the second or the successive fuel injection. When the answer is No in step S201, that is, when the current fuel injection is the first injection, the procedure proceeds to step S202 in which an average pressure Pave of the detection pressure during a specified time period T12 is computed, and the average pressure Pave is set to a reference pressure base value Psb(n). This process in step S202 corresponds to a reference pressure computing means in the present invention. The specified time period T12 is defined in such a manner as to include the fuel-injection-start command timing "Is".

When the answer is Yes in step S201, that is, when the current fuel injection is the second or successive fuel injection, the procedure proceeds to step S203 in which a first pressure drop ΔP1 (refer to FIG. 5C) is computed. This first pressure drop ΔP1 depends on the fuel injection quantity of the previous fuel injection. This fuel injection quantity of the previous fuel injection is computed in step S30 or computed based on a time period from the timing "Is" to the timing "Ie". A map correlating the fuel injection quantity "Q" and the first pressure drop ΔP1 is previously stored in the ECU 30. The first pressure drop ΔP1 can be derived from this map.

Referring to FIG. 5C, the first pressure drop ΔP1 will be described in detail. As described above, the detection pressure after the changing point "P8" is attenuated at a specified cycle T10 to converge on a convergent value Pu(n). This convergent value Pu(n) is an injection start pressure of the successive fuel injection. In a case that the interval between (n−1)th fuel injection and n-th fuel injection is short, the convergent value Pu(n) of the n-th fuel injection is smaller than the convergent value Pu(n−1) of the (n−1)th fuel injection. This difference between Pu(n) and Pu(n−1) corresponds to the first pressure drop ΔP1 which depends on the fuel injection quantity of the (n−1)th fuel injection. That is, as the fuel injection quantity of the (n−1)th fuel injection is larger, the first pressure drop ΔP1 becomes larger and the convergent value Pu(n) becomes smaller.

In step S204, the first pressure drop ΔP1 is subtracted from the reference pressure base value Psb(n−1) to substitute Psb (n) for Psb(n−1).

For example, in a case that the second fuel injection is detected, the first pressure drop ΔP1 is subtracted from the reference pressure base value Psb(1) computed in step S202 to obtain the reference pressure base value Psb(2). In a case that the interval between (n−1)th fuel injection and n-th fuel injection is sufficiently long, since the first pressure drop ΔP1 comes close to zero, the convergent value Pu(n−1) is substantially equal to the reference pressure base value Psb(n).

In step S205, a second pressure drop ΔP2 (refer to FIG. 5C) is computed. This second pressure drop ΔP2 is generated due to a fuel leak from the leak hole 24.

Referring to FIG. 5C, the second pressure drop ΔP2 will be described in detail. After the control valve 23 is unseated according to the SFC-signal, when the sufficient amount of fuel flows out from the backpressure chamber Cd through the leak hole 24 to decrease the backpressure, the needle valve 20*c* starts to open the injection port 20*f* and the actual fuel injection is started. Thus, during a period after the control valve 23 is opened until the needle valve 20*c* is opened, the detection pressure decreases due to the fuel leak through the leak hole 24 even though the actual fuel injection has not been performed yet. This detection pressure drop corresponds to the second pressure drop ΔP2. The second pressure drop ΔP2 may be a constant value which is previously determined. Alternatively, the second pressure drop ΔP2 may be set according to the average pressure Pave computed in step S102. That is, as the average pressure Pave is larger, the second pressure drop ΔP2 is set larger.

In step S206, the second pressure drop ΔP2 computed in step S205 is subtracted from the reference pressure base value Psb(n) computed in step S202 or S204 to obtain the reference pressure Ps(n). As described above, according to the processes in steps S201 to S206, the reference pressure Ps(n) is computed according to the number of the injection-stage.

Referring back to FIG. 11, in step S104, the fuel-injection-start timing "R3" is computed based on the reference pressure Ps(n) computed in step S103 and the falling-modeling function f1(*t*) obtained in step S102. The process in step S104 corresponds to a fuel-injection-start-timing computing means.

Specifically, the reference pressure Ps(n) is substituted into the falling-modeling function f1(*t*), whereby a timing "t" is obtained as the fuel-injection-start timing "R3". That is, the reference pressure Ps(n) is expressed by a horizontal dot-line in FIG. 10B, and a timing "te" of an intersection between the reference pressure Ps(n) and the falling-modeling function f1(*t*) is computed as the fuel-injection-start timing "R3".

The above explanation of the flowchart shown in FIG. 11 is made referring to FIGS. 10A to 10C showing a case that the fuel injection quantity is small and the changing points "P4", "P5", "P6" do not appear. However, the processing shown in FIG. 11 can be similarly applied to both a case that the fuel injection quantity is large and the changing points "P4", "P5", "P6" appear as shown in FIGS. 5A to 5C, and a case that the pressure wave compensation process is performed so that the changing points "P1" and "P2" appear. That is, the fuel-injection-start timing "R3" can be computed based on the pressure waveform from the changing point "P3" to the changing point "P4" of the detection pressure in FIG. 5C.

<Step S26: Computation of Fuel-Injection-End Timing>

Figure 13:
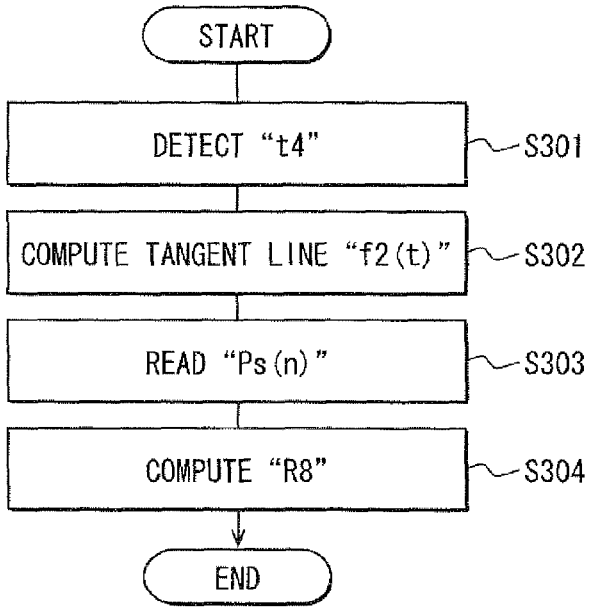
FIG. 13 is a flowchart showing a processing for computing the fuel-injection-end timing.

FIG. 13 is a flowchart showing a process in step S26 for computing a fuel-injection-end timing "R8". In steps S301 and S302, the pressure waveform in which the detection pressure is increasing is modeled by a function. This rising waveform is encircled by an alternate long and short dash line A2 in FIG. 10B. The process in step S26 corresponds to a fuel-injection-end timing computing means, and the processes in steps S301 and S302 correspond to a rising waveform modeling means in the present invention.

Referring to FIG. 10C, in step S301, the computer detects a timing "t4" at which the differential value computed in step S24 first becomes maximum after the fuel-injection-start command timing "Is". The detection pressure corresponding to the timing "t4" is denoted by "P20*a*" on the pressure waveform.

In step S302, a tangent line of the rising waveform A2 at the point "P20*a*" is expressed by a rising-modeling function f2(*t*) of an elapsed time "t". This rising-modeling function f2(*t*) corresponds to a rising-modeling function. This rising-modeling function f2(*t*) is a linear function, which is shown by a dot-line f2(*t*) in FIG. 10B.

In step S303, a reference pressure Ps(n) is read. This reference pressure Ps(n) is computed according to a flowchart shown in FIG. 12. In step S304, the fuel-injection-end timing "R8" is computed based on the reference pressure Ps(n) computed in step S303 and the rising-modeling function f2(*t*) obtained in step S302. The process in step S304 corresponds to a fuel-injection-end-timing computing means.

Specifically, the reference pressure Ps(n) is substituted into the rising-modeling function f2(*t*), whereby a timing "t" is obtained as the fuel-injection-end timing "R8". That is, the reference pressure Ps(n) is expressed by a horizontal dot-line in FIG. 10B, and a timing "te" of an intersection between the reference pressure Ps(n) and the rising-modeling function f2(*t*) is computed as the fuel-injection-end timing "R8".

The above explanation of the flowchart shown in FIG. 13 is made referring to FIGS. 10A to 10C showing a case that the fuel injection quantity is small and the changing points "P4", "P5", "P6" do not appear. However, the processing shown in FIG. 13 can be similarly applied to a case that the fuel injection quantity is large and the changing points "P4", "P5", "P6" appear as shown in FIGS. 5A to 5C. That is, the fuel-injection-end timing "R8" can be computed based on the pressure waveform from the changing point "P7" to the changing point "P8" of the detection pressure in FIG. 5C.

<Step S27: Computation of Maximum Fuel Injection Rate>

Figure 14:
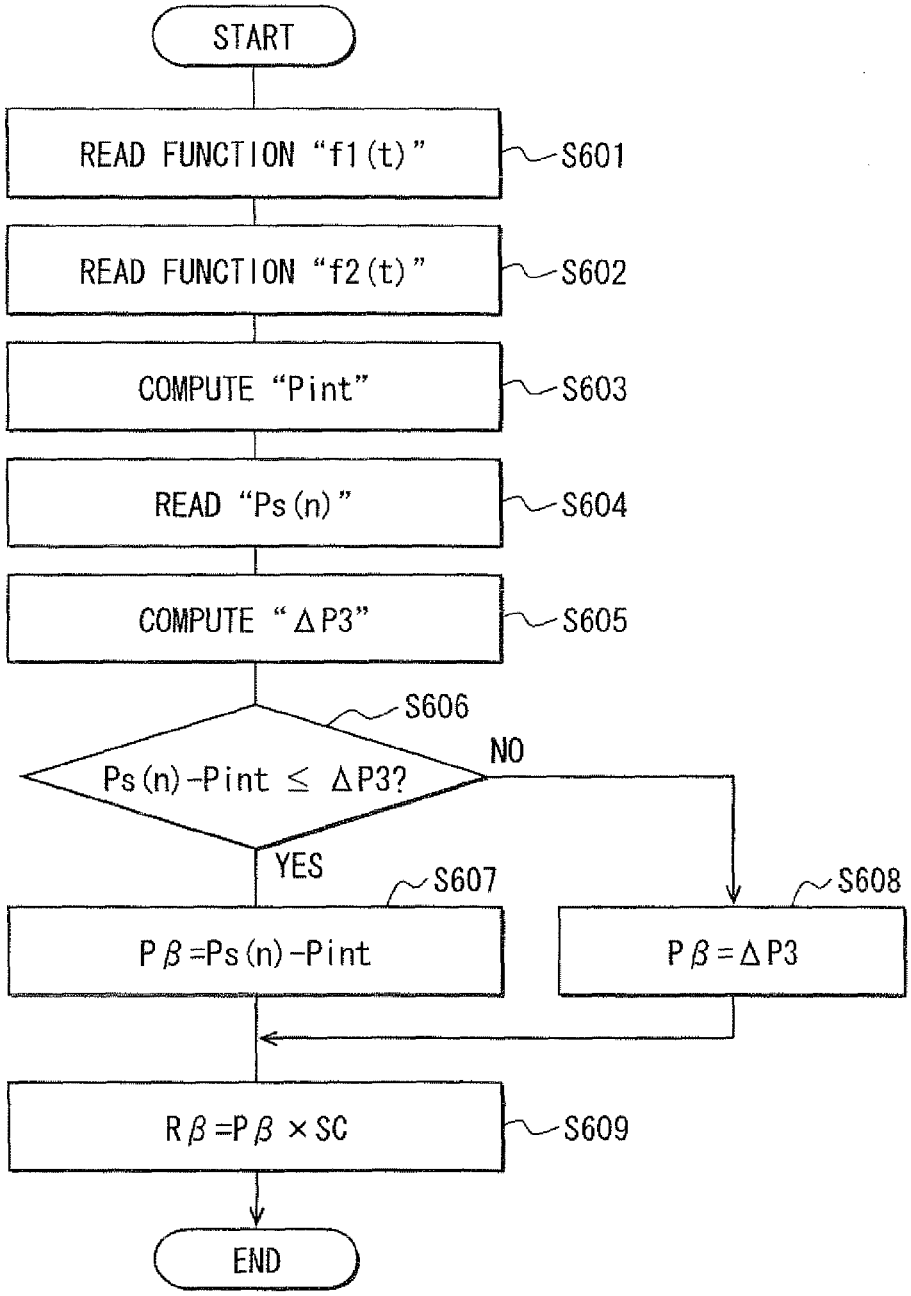
FIG. 14 is a flowchart showing a processing for computing a maximum fuel injection rate.

FIG. 14 is a flowchart showing a procedure for computing the maximum fuel injection rate "Rβ" in step S27. The process in step S27 corresponds to a maximum fuel injection rate computing means. In step S601, the falling-modeling function f1(*t*) computed in step S102 is read. In step S602, the rising-modeling function f2(*t*) computed in step S302 is read.

In step S603, an intersection point of a line expressed by the falling-modeling function f1(*t*) and a line expressed by the rising-modeling function f2(*t*) is obtained, and a fuel pressure at the intersection point is computed as an intersection pressure "Pint". The process in step S603 corresponds to an intersection pressure computing means.

In step S604, a reference pressure Ps(n) is read. This reference pressure Ps(n) is computed according to a flowchart shown in FIG. 12. In step S605, a third pressure drop ΔP3 (refer to FIGS. 15A and 15B) is computed. The third pressure drop ΔP3 represents a pressure drop from when the needle valve 20*c* seats on the seat surface 20*g* to close the injection port 20*f* to when the needle valve 20*c* is fully lifted up to open the injection port 20*f*. As the reference pressure Ps(n) is larger, the fuel flow velocity becomes larger, so that the detection pressure becomes smaller. In other word, as the reference pressure Ps(n) becomes larger, the third pressure drop ΔP3 becomes larger.

Figure 15A:
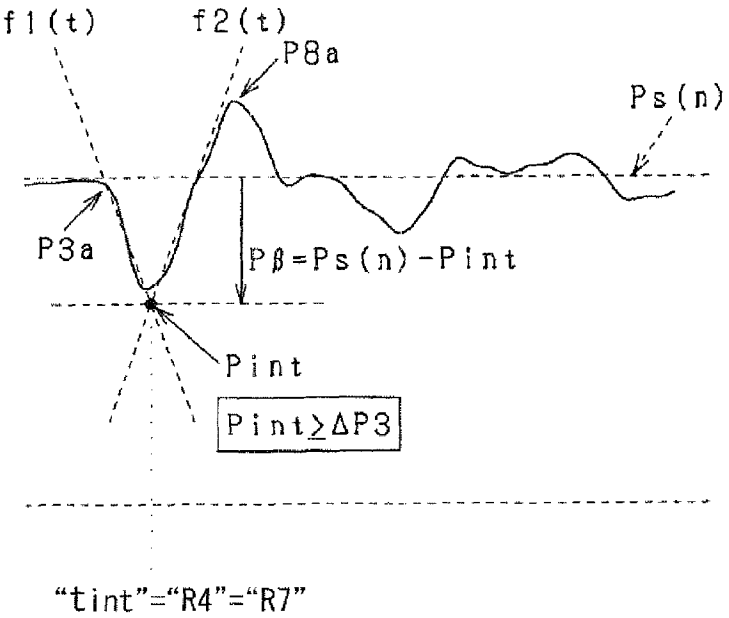
FIGS. 15A and 15B are timing charts for explaining a computing method of the maximum fuel injection rate, the maximum-fuel-injection-rate-reach timing, and the fuel-injection-rate-decrease-start timing by using of the modeling functions.
Figure 15B:
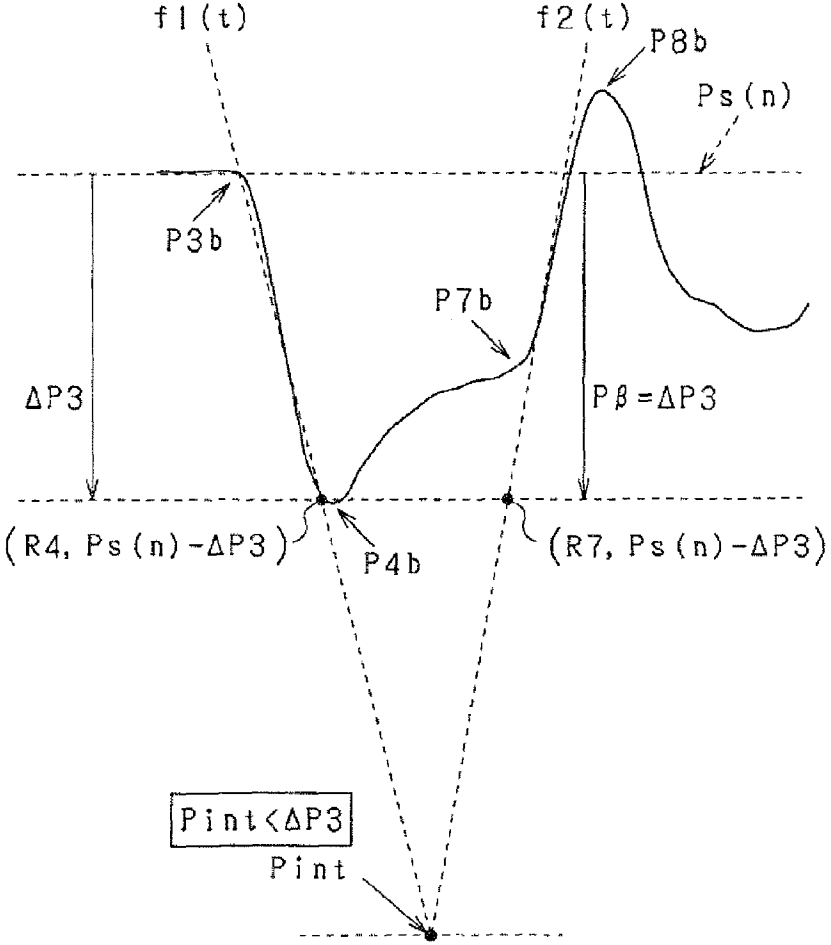

A solid line in FIG. 15A shows a pressure waveform of the detection pressure in a case that the fuel injection quantity is relatively small, for example, 2 $mm^3$. A solid line in FIG. 15B shows a pressure waveform of the detection pressure in a case that the fuel injection quantity is relatively large, for example, 50 $mm^3$. It should be noted that the changing points "P3*b*", "P4*b*", "P7*b*", and "P8*b*" in FIG. 15B correspond to the changing points "P3", "P4", "P7", and "P8" in FIG. 5C respectively.

At a beginning of a fuel injection period, a lift amount of the needle valve 20*c* is small. In other word, a clearance gap between the sealing surface 20*g* and the seat surface 20*h* is small. A fuel flow rate flowing through the high-pressure passage 25 is restricted by the clearance gap between the sealing surface 20*g* and the seat surface 20*h*. The fuel injection quantity injected from the injection port 20*f* depends on the lift amount of the needle valve 20*c*. When the lift amount of the needle valve 20*c* exceeds a specified value, the fuel flow rate is restricted only by the injection port 20*f*. Thus, the fuel injection rate becomes substantially a constant value (an upper rate) without respect to the lift amount of the needle valve. Therefore, when the needle valve 20*c* is fully lifted up, the fuel injection rate is substantially constant, which corresponds to a period from the changing point "R4" to the changing point "R7" in FIG. 5B. Such a period is referred to as an injection-port restricting period. On the other hand, at a beginning of the fuel injection period, the fuel injection rate increases according to an increase in the lift amount of the needle valve 20*c*, which corresponds to a period from the changing point "R3" to the changing point "R4" in FIG. 5B. Such a period is referred to as a seat-surface restricting period.

In succeeding steps S606 to S609 (a maximum fuel injection rate computing means), the maximum pressure drop "P13" and the maximum fuel injection rate "R13" are computed. When the fuel injection quantity is small at the seat-surface restricting period, the maximum pressure drop "Pβ and the maximum fuel injection rate "Rβ" are computed based on the shapes of the falling waveform A1 and the rising waveform A2, as shown in FIG. 15A. On the other hand, when the fuel injection quantity is large at the injection-port restricting period, the maximum pressure drop "Pβ and the maximum fuel injection rate "Rβ" are computed based on the third pressure drop ΔP3 without respect to the shapes of the falling waveform A1 and the rising waveform A2, as shown in FIG. 15B.

In step S606, the computer determines whether it is at the seat-surface restricting period (small injection quantity) or the injection-port restricting period (large injection quantity). Specifically, the intersection pressure "Pint" computed is subtracted from the reference pressure Ps(n) to obtain a pressure difference (Psn(n)−Pint). The computer determines whether this pressure difference (Psn(n)−Pint) is smaller than or equal to the third pressure drop ΔP3.

When the answer is YES (Ps(n)−Pint≦ΔP3), the computer determines that it is at the seat-surface restricting period (small injection quantity), the procedure proceeds to step S607 in which the pressure difference (Psn(n)−Pint) is determined as the maximum fuel pressure drop "Pβ". On the other hand, when the answer is NO (Ps(n)−Pint>ΔP3), the computer determines that it is at the injection-port restricting period (large injection quantity), the procedure proceeds to step S608 in which the third pressure amount ΔP3 is determined as the maximum fuel pressure drop "Pβ".

Since the maximum fuel pressure drop "Pβ" and the maximum fuel injection rate "Rβ" have a high correlation with each other, the maximum fuel injection rate "Rβ" is computed by multiplying the maximum fuel pressure drop "Pβ" by a specified constant "SC" in step S609.

<Step S28: Computation of MFIRR Timing and FIRDS Timing>

Figure 16:
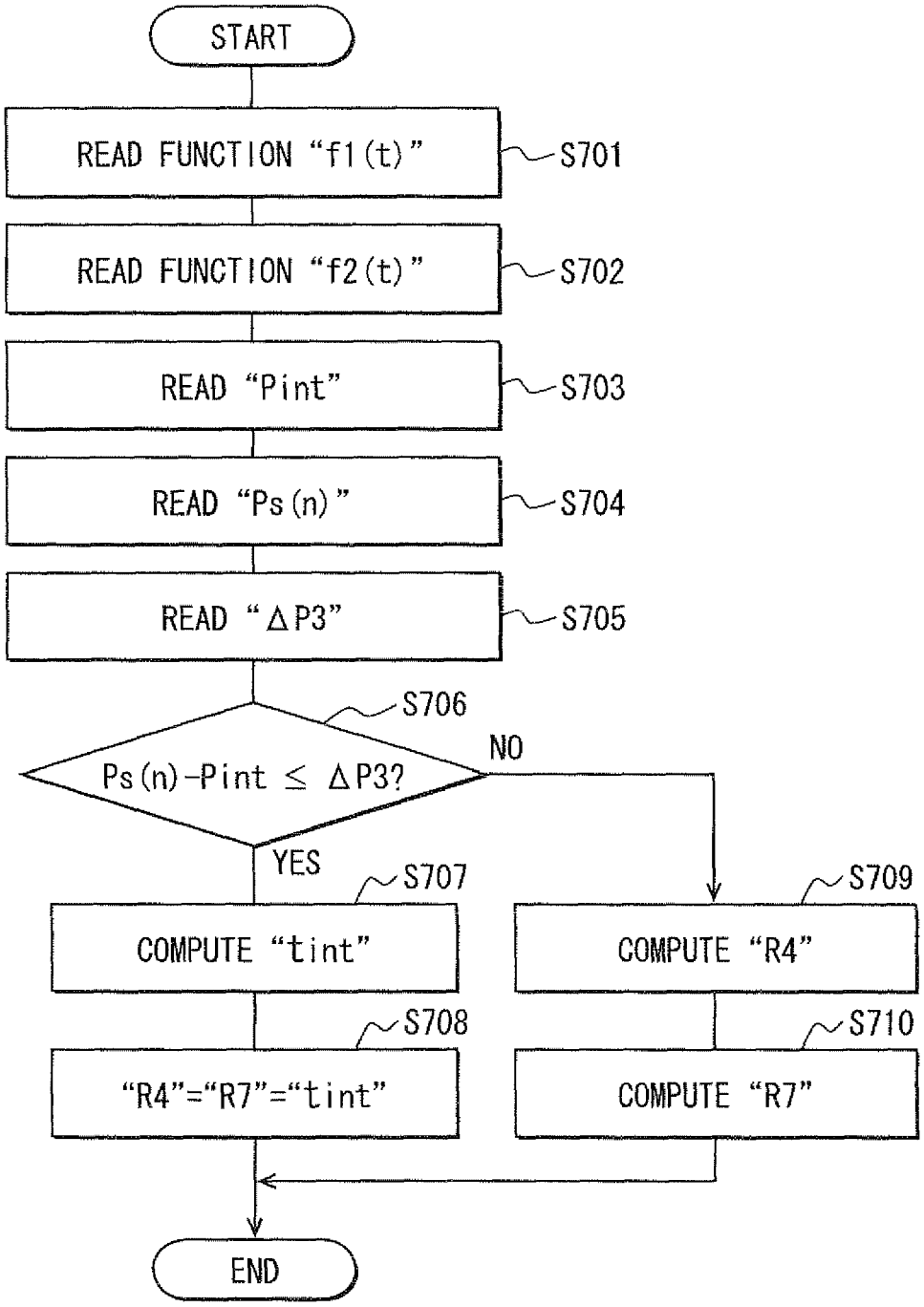
FIG. 16 is a flowchart showing a processing for computing the maximum-fuel-injection-rate-reach timing and the fuel-injection-rate-decrease-start timing.

FIG. 16 is a flowchart showing a procedure for computing the MFIRR timing "R4" and the FIRDS timing "R7" in step S28. The process in step S28 corresponds to a changing point computing means. In step S701, the falling-modeling function f1(*t*) computed in step S102 is read. In step S702, the rising-modeling function f2(*t*) computed in step S302 is read.

In step S703, the intersection pressure "Pint" computed in step S603 is read. In step S704, the reference pressure Ps(n) is read, which is computed according to a flowchart shown in FIG. 12. In step S705, the third pressure drop ΔP3 computed in step S605 is read.

In succeeding steps S706 to S710, the MFIRR timing "R4" and the FIRDS timing "R7" are computed. When the fuel injection quantity is small at the seat-surface restricting period, the MFIRR timing "R4" and the FIRDS timing "R7" are computed based on the shapes of the falling waveform A1 and the rising waveform A2, as shown in FIG. 15A. In this case, the MFIRR timing "R4" is equal to the FIRDS timing "R7".

As shown in FIG. 15B, when the fuel injection quantity is large at the injection-port restricting period, the maximum fuel pressure drop "Pβ" is computed based on the third pressure drop ΔP3 and the MFIRR timing "R4" is computed based on the maximum fuel pressure drop "Pβ" and the shape of the falling waveform A1. Further, the FIRDS timing "R7" is computed based on the maximum fuel pressure drop "Pβ" and the shape of the rising waveform A2.

In step S706, the computer determines whether it is at the seat-surface restricting period (small injection quantity) or the injection-port restricting period (large injection quantity). Specifically, the intersection pressure "Pint" is subtracted from the reference pressure Ps(n) to obtain a pressure difference (Psn(n)−Pint). The computer determines whether this pressure difference (Psn(n)−Pint) is smaller than or equal to the third pressure drop ΔP3.

When the answer is YES (Ps(n)−Pint≦ΔP3), the computer determines that it is at the seat-surface restricting period (small injection quantity). The procedure proceeds to step S707 in which an intersection timing "tint" is computed. The intersection timing "tint" represents a timing at which a line represented by the falling-modeling function f1(*t*) and a line represented by the rising-modeling function f2(*t*) intersect with each other, as shown in FIG. 15A. In step S708, the intersection timing "tint" is defined as the MFIRR timing "R4" and the FIRDS timing "R7".

On the other hand, when the answer is NO (Ps(n)−Pint>ΔP3), the computer determines that it is at the injection-port restricting period (large injection quantity). The procedure proceeds to step S709 in which the third pressure drop ΔP3 is subtracted from the reference pressure value Ps(n) to obtain a difference pressure (Ps(n)−ΔP3). The difference pressure (Ps(n)−ΔP3) is substituted into the falling-modeling function f1(*t*), whereby the MFIRR timing "R4" is computed. In step S710, the difference pressure (Ps(n)−ΔP3) is substituted into the rising-modeling function f2(*t*), whereby the FIRDS timing "R7" is computed.

<Steps S29 and S30: Computation of Waveform of Fuel Injection Rate and Fuel Injection Quantity>

Figure 17A:
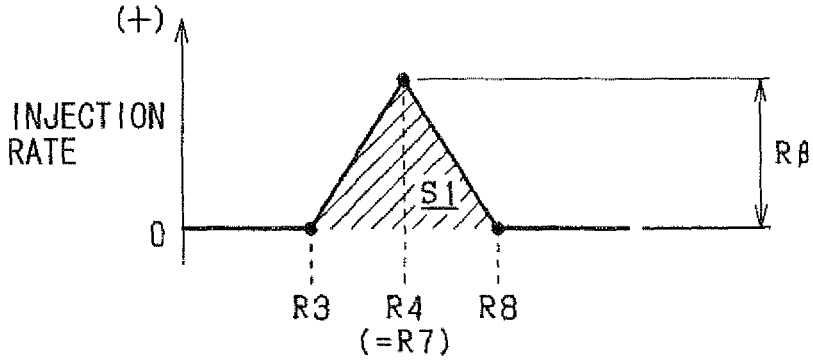
FIGS. 17A and 17B are charts for explaining a computing method of a waveform of a fuel injection rate and a fuel injection.
Figure 17B:
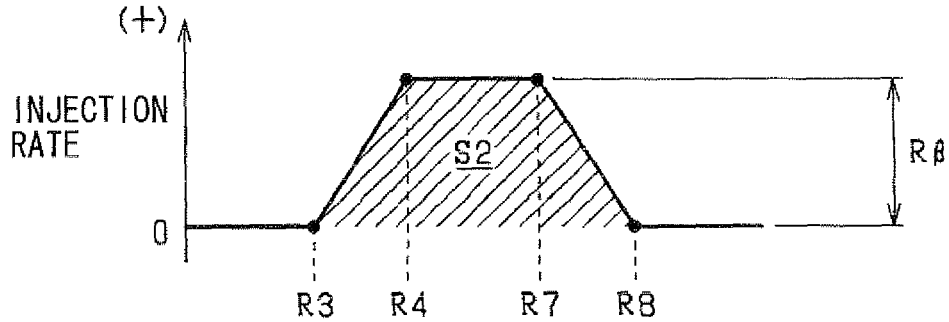

In step S29, the computer computes the waveform of the fuel injection rate based on the above injection condition values "R3", "R8", "Rβ", "R4", "R7". The process in step S29 corresponds to a fuel injection rate waveform computing means. FIG. 17A shows a waveform of the fuel injection rate in a case that the fuel injection quantity is small as shown in FIG. 15A. FIG. 17B shows a waveform of the fuel injection rate in a case that the fuel injection quantity is large as shown in FIG. 15B.

In step S30, a fuel injection quantity is computed based on the waveform of the fuel injection rate computed in step S29. The process in step S30 corresponds to a fuel injection quantity computing means. A shaded area "S1" in FIG. 17A and a shaded area "S2" in FIG. 17B are respectively computed as the fuel injection quantity "Q".

The waveform of the fuel injection rate computed in step S29 and the fuel injection quantity "Q" computed in step S30 are used for updating the map which is used in step S11. Thus, the map can be suitably updated according to an individual difference and a deterioration with age of the fuel injector 20.

According to the present embodiment described above, following advantages can be obtained.

(1) The falling waveform A1 and the rising waveform A2 hardly receive disturbances and their shapes are stable. That is, the slope and the intercept of the falling-modeling function f1(*t*) hardly receive disturbances and are constant values correlating to the MFIRR timing "R4". Further, the slope and the intercept of the rising-modeling function f2(*t*) hardly receive disturbances and are constant values correlating to the FIRDS timing "R7".

Therefore, in a case that the fuel injection quantity is small as shown in FIG. 17A, the intersection timing "tint" is computed, at which the straight lines expressed by the first and rising-modeling functions f1(*t*), f2(*t*) intersect to each other. Since this intersection timing "tint" is defined as the MFIRR timing "R4" (the FIRDS timing "R7"), the MFIRR timing "R4" (the FIRDS timing "R7") is accurately computed.

(2) The tangent line on the falling waveform A1 at the timing "t2" is computed as the falling-modeling function f1(*t*). Since the falling waveform A1 hardly receives disturbances, as long as the timing "t2" appears in a range of the falling waveform A1, the falling-modeling function f1(*t*) does not vary by large amount even if the timing "t2" is dispersed. Similarly, even if the timing "t4" is dispersed, the rising-modeling function f2(*t*) does not vary by large amount. Thus, the intersection timing "tint" hardly receives disturbances, whereby the MFIRR timing "R4" and the FIRDS timing "R7" can be accurately computed.

(3) During the seat-surface restricting period (small injection quantity), the waveform of the fuel injection rate is computed as shown in FIG. 17A. The shape of the waveform is triangle. The intersection timing "tint" is defined as the MFIRR timing "R4" and the FIRDS timing "R7". Thus, above described advantages (1) and (2) are effectively achieved.

During the injection-port restricting period (large injection quantity), the waveform of the fuel injection rate is computed as shown in FIG. 17B. The shape of the waveform is trapezoid. The MFIRR timing "R4" and the FIRDS timing "R7" deviate from the intersection timing "tint". The difference pressure (Ps(n)−ΔP3) is substituted into the falling-modeling function f1(*t*), whereby the MFIRR timing "R4" is computed. The difference pressure (Ps(n)−ΔP3) is substituted into the rising-modeling function f2(*t*), whereby the FIRDS timing "R7" is computed. Therefore, the MFIRR timing "R4" and the FIRDS timing "R7" can be computed with high accuracy even in a case that the fuel injection quantity is large.

(4) It is determined whether a large quantity injection or small quantity injection is performed in steps S606 and S706 with high accuracy. Thus, the computing accuracy of the MFIRR timing "R4" and the FIRDS timing "R7" can be enhanced.

(5) Since the reference pressure Ps(n) is computed based on the average pressure Pave, the reference pressure Ps(n) hardly receives disturbances even if the pressure waveform is disturbed as shown by a broken line L2 in FIG. 15B. It can be determined whether a large quantity injection or small quantity injection is performed with high accuracy. Thus, the computing accuracy of the MFIRR timing "R4" and the FIRDS timing "R7" can be enhanced.

(6) Since the reference pressure base value Psb(n) of the second or successive fuel injection is computed based on the average pressure Pave of the first fuel injection (reference pressure base value Psb(1)), the reference pressure base value Psb(n) of the second or successive fuel injection can be accurately computed even if the average pressure Pave of the second or successive fuel injection can not be accurately computed. Thus, even if the interval between adjacent fuel injections is short, the MFIRR timing "R4" and the FIRDS timing "R7" of the second and successive fuel injection can be accurately computed.

(7) The first pressure drop ΔP1 due to the previous fuel injection is subtracted from the reference pressure base value Psb(n−1) of the previous fuel injection to obtain the reference pressure base value Psb(n) of the current fuel injection. That is, when the reference pressure base value Psb(n) of the second and successive fuel injection is computed based on the average pressure Pave of the first fuel injection, the reference pressure base value Psb(n) is computed based on the first pressure drop ΔP1. Thus, the reference pressure Ps(n) can be set close to the actual fuel-injection-start pressure so that the maximum fuel pressure drop "Pβ" of the second and successive fuel injection can be accurately computed. Thus, it can be determined whether a large quantity injection or small quantity injection is performed with high accuracy. The computing accuracy of the MFIRR timing "R4" and the FIRDS timing "R7" can be enhanced.

(8) The second pressure drop ΔP2 due to the fuel leak is subtracted from the reference pressure base value Psb(n) to obtain the reference pressure Ps(n) of the current fuel injection. Thus, the reference pressure Ps(n) can be set close to the actual fuel injection start pressure. It can be determined whether a large quantity injection or small quantity injection is performed with high accuracy. The computing accuracy of the MFIRR timing "R4" and the FIRDS timing "R7" can be enhanced.

(9) The falling waveform A1 hardly receives disturbances and its shape is stable. That is, the slope and the intercept of the falling-modeling function f1(*t*) hardly receive disturbances and are constant values correlating to the fuel-injection-start timing "R3". Therefore, according to the present embodiment, the fuel-injection-start timing "R3" can be computed with high accuracy.

(10) The rising waveform A2 hardly receives disturbances and its shape is stable. That is, the slope and the intercept of the rising-modeling function f2(*t*) hardly receive disturbances and are constant values correlating to the fuel-injection-end timing "R8". Therefore, according to the present embodiment, the fuel-injection-end timing "R8" can be computed with high accuracy.

(11) The maximum fuel pressure drop "Pβ" has a proportional relation with the maximum fuel injection rate "Rβ". Thus, when the maximum fuel pressure drop "Pβ" is accurately computed, the maximum fuel injection rate "Rβ" can be obtained accurately. The maximum fuel injection rate "Rβ" has a high correlation with the falling waveform A1 and the rising waveform A2. Furthermore, the falling waveform A1 and the rising waveform A2 hardly receive disturbances and their shapes are stable. That is, the slopes and the intercepts of the falling-modeling function f1(*t*) and the rising-modeling function f2(*t*) hardly receive disturbances and are constant values correlating to the maximum pressure drop "Pβ".

According to the present embodiment, the reference pressure Ps(n) is computed so as to be close to a fuel pressure at the fuel-injection-start timing, the intersection pressure "Pint" is computed, and the pressure drop from the reference pressure Ps(n) to the intersection pressure "Pint" is defined as the maximum fuel pressure drop "Pβ". Thus, the maximum fuel injection rate "Rβ" can be accurately computed based on the maximum fuel pressure drop "Pβ".

(12) During the seat-surface restricting period (small injection quantity), a fuel pressure drop from the reference fuel pressure Ps(n) to the intersection pressure "Pint" is computed as the maximum fuel pressure drop "Pβ". Thus, above described advantage (11) is effectively achieved. On the other hand, during the injection-port restricting period, the third fuel pressure drop ΔP3 is computed as the maximum pressure drop "Pβ" without respect to the intersection pressure "Pint". Thus, it can be avoided that the computation value of the maximum fuel pressure drop "Pβ" exceeds the third fuel pressure drop ΔP3. The accuracy of computing the maximum fuel pressure drop "Pβ" is not deteriorated during the injection-port restricting period.

(13) Since the waveform of the fuel injection rate is computed based on the above injection condition values "R3", "R8", "Rβ", "R4", "R7", the waveform of the fuel injection rate can be computed with high accuracy. Furthermore, the fuel injection quantity can be accurately computed based on the waveform of the fuel injection rate.

Second Embodiment

Figures 18A, 18B, 18C:
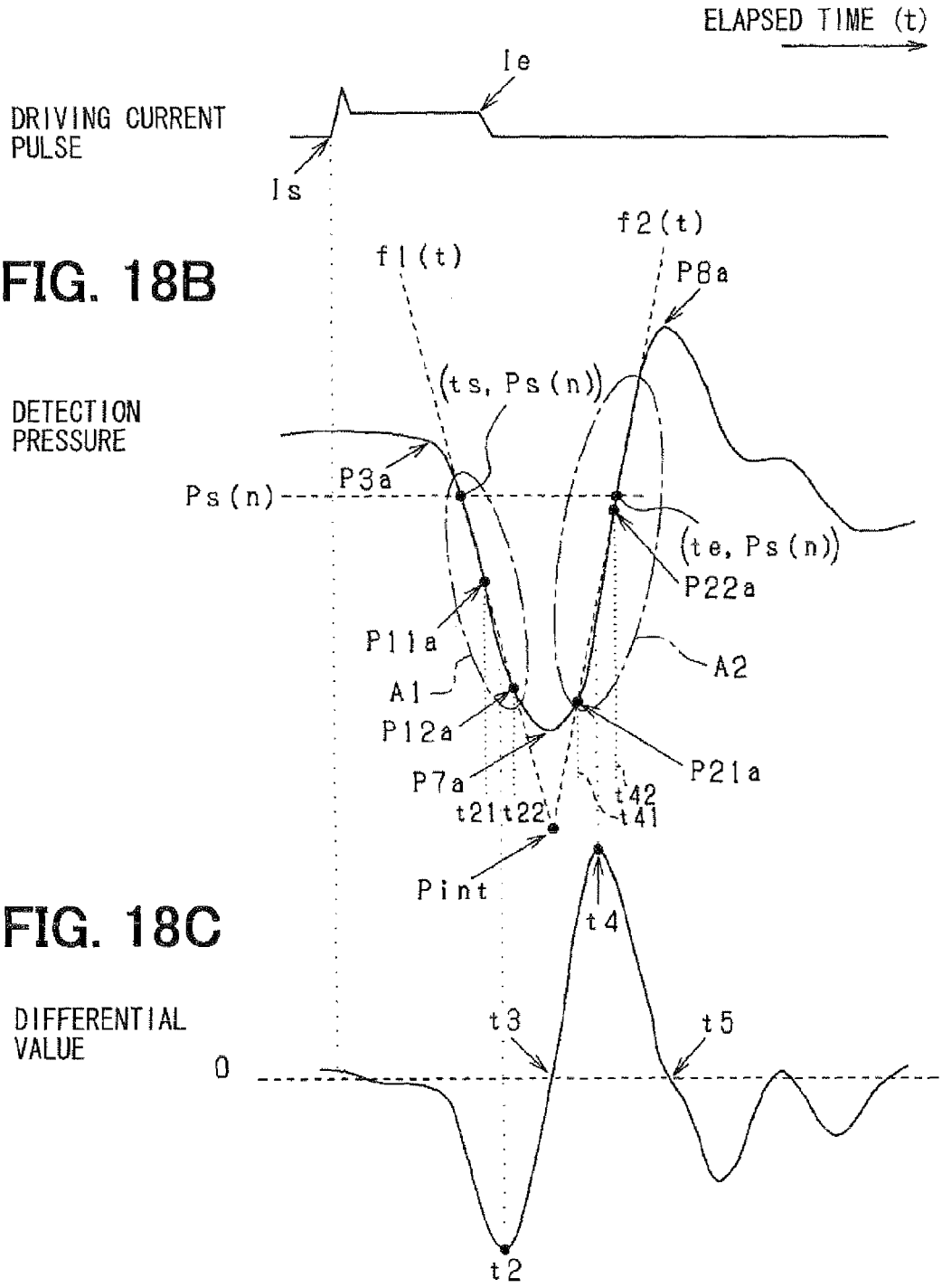
FIGS. 18A to 18C are timing charts for explaining a computing method of a falling-modeling function and a rising-modeling function according to a second embodiment of the present invention.
Figure 19A:
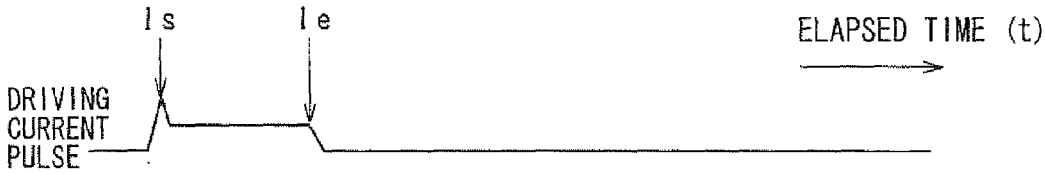
FIGS. 19A to 19C are time charts for explaining a computing method of the maximum-fuel-injection-rate-reach timing and the fuel-injection-rate-decrease-start timing, which the present inventors have studied.
Figure 19B:
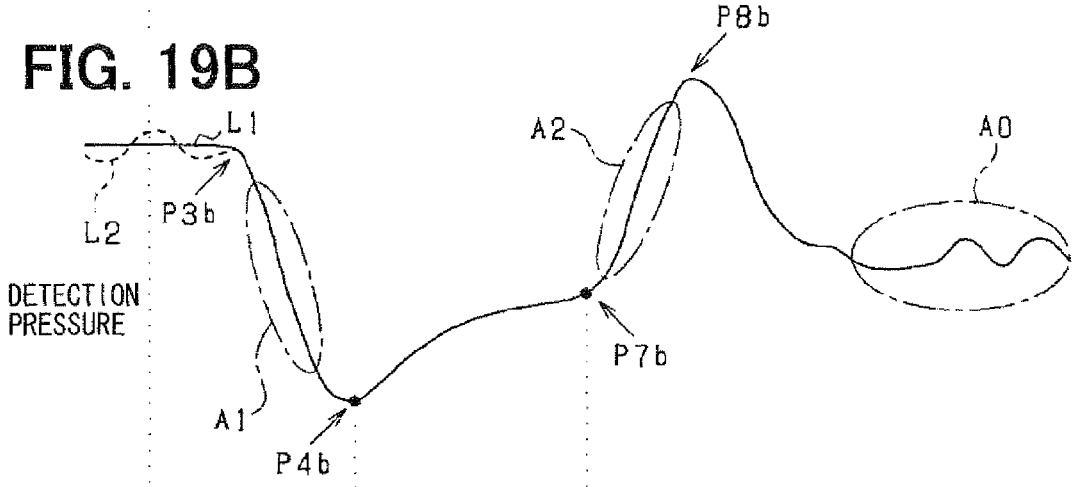
Figure 19C:
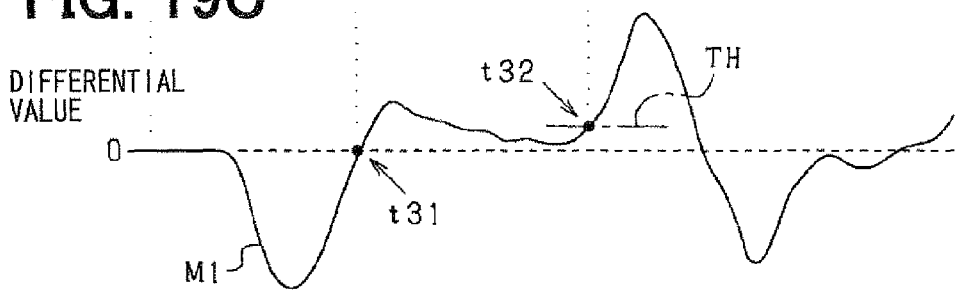

In the above first embodiment, the tangent line at the timing "t2" is defined as the falling-modeling function f1(*t*), and the tangent line at the timing "t4" is defined as the rising-modeling function f2(*t*). In a second embodiment, as shown in FIG. 18, a straight line passing through specified two points P11*a*, P12*a* on the falling waveform A1 is defined as the falling-modeling function f1(*t*). Similarly, a straight line passing through specified two points P21*a*, P22*a* on the rising waveform A2 is defined as the rising-modeling function f2(*t*). An intersection pressure (Pint) and an intersection timing (tint) are computed, at which the straight lines expressed by the first and the rising-modeling function intersect to each other.

It should be noted that the specific two points "P11*a*", "P12*a*" represent the detection pressure on the falling waveform A1 at timings "t21" and "t22" which are respectively before and after the timing "t2". Similarly, the specific two points "P21*a*", "P22*a*" represent the detection pressure on the rising waveform A2 at timings "t41" and "t42" which are respectively before and after the timing"t4".

According to the second embodiment, the same advantages as the first embodiment can be achieved. Moreover, as a modification of the second embodiment, three or more specific points are defined on the falling waveform A1, and the falling-modeling function f1(*t*) can be computed by least-square method in such a manner that a total distance between the specific points and the falling-modeling function f1(*t*) becomes minimum. Similarly, the rising-modeling function f2(*t*) can be computed by least-square method based on three or more specific points on the rising waveform A2.

Other Embodiment

The present invention is not limited to the embodiments described above, but may be performed, for example, in the following manner. Further, the characteristic configuration of each embodiment can be combined.

In the above-mentioned first embodiment, an appearance timing of each changing point "P3", "P8", "P4", and "P7" is computed as an appearance timing of each changing point "R3", "R8", "R4", and "R7" on the waveform of the fuel injection rate. However, there is a deviation between the appearance timing of each changing point "P3" "P8", "P4", "P7" and the appearance timing of each changing point "R3", "R8", "R4", "R7" due to a response delay. This is because a certain time period is necessary for the fuel pressure variation to be propagated from the injection port 20*f* to the pressure sensor 20*a*. In view of this point, the appearance timing of each changing point "R3", "R8", "R4", "R7" may be corrected to be advanced by the response delay. This response delay may be previously determined or variably changed according to the fuel injection quantity.

In the first embodiment, each changing point "R3", "R8", "Rβ", "R4", "R7" is computed based on the falling waveform A1 and the rising waveform A2. However, the changing points "R3", "R8", "Rβ" may be computed without respect to the waveforms A1, A2.

For example, the computer detects a timing "t1" at which the differential value computed in step S24 becomes lower than a predetermined threshold after the fuel-injection-start command timing "Is". This timing "t1" may be defined as an appearance timing of the changing point "P3*a*" (fuel-injection-start timing "R3").

Also, the computer detects a timing "t5" at which the differential value becomes zero after the fuel-injection-start command timing "Is" and a timing "t4" at which the differential value is a maximum value. This timing "t5" may be defined as an appearance timing of the changing point "P8*a*" (fuel-injection-end timing "R8").

Also, the computer computes a difference between the detection pressure at the timing "t3" and a reference pressure Ps(n) as the maximum pressure drop "Pβ". The maximum pressure drop "Pβ" is multiplied by a proportional constant to obtain the maximum injection rate "Rβ", The first and rising-modeling functions f1(*t*) and f2(*t*) may be high-dimensional functions. The falling waveform A1 and the rising waveform A2 can be modeled by a curved line, respectively.

The falling waveform A1 and the rising waveform A2 can be modeled by a plurality of straight lines. In this case, different functions f1(*t*), f2(*t*) for every range of time will be used.

The reference pressure base value Psb(1) can be used as the reference pressure base value Psb(n≧2).

The changing points "R3", "R8", "Rβ", "R4", "R7" can be computed based on the specified two points "P11*a*", "P12*a*" on the falling waveform A1 and specified two points "P21*a*" "P22*a*" on the rising waveform A2 without computing the modeling functions f1(*t*) and f2(*t*).

The first pressure drop ΔP1 due to the second and successive fuel injection can be computed based on the average pressure Pave (reference pressure base value Psb(1)) of the first fuel injection. If the first pressure drop API is computed based on both the reference pressure base value Psb(1) and a fuel temperature, the reference pressure for computing the maximum fuel pressure drop "Pβ" of the second and the successive injection can be close to the actual fuel-injection-start pressure with high accuracy.

The fuel pressure sensor can be arranged in the housing 20*e* as indicated by a dashed line with reference numeral 200*a* in FIG. 2. The fuel pressure in the fuel passage 25 can be detected by the pressure sensor 200*a*.

In a case that the fuel pressure sensor 20*a* is arranged close to the fuel inlet 22, the fuel pressure sensor 20*a* is easily mounted. In a case that the fuel pressure sensor 20*a* is disposed in the housing 20*e*, since the fuel pressure sensor 20*a* is close to the fuel injection port 20*f*, the variation in pressure at the fuel injection port 20*f* can be accurately detected.

A piezoelectric injector may be used in place of the electromagnetically driven injector shown in FIG. 2. The direct-acting piezoelectric injector causes no pressure leak through the leak hole and has no backpressure chamber so as to transmit a driving power. When the direct-acting injector is used, the fuel injection rate can be easily controlled.

What is claimed is:

1. A fuel injection detecting device detecting a fuel injection condition, the fuel injection detecting device being applied to a fuel injection system in which a fuel injector injects a fuel accumulated in an accumulator, the fuel injection detecting device comprising:

a fuel pressure sensor provided in a fuel passage fluidly connecting the accumulator and a fuel injection port of the fuel injector, the fuel pressure sensor detecting a fuel pressure which varies due to a fuel injection from the fuel injection port;

a falling-modeling means for modeling a falling waveform of the fuel pressure by a falling-modeling function during a period in which the fuel pressure decreases due to a fuel injection rate increase;

a rising-modeling means for modeling a rising waveform of the fuel pressure by a rising-modeling function during a period in which the fuel pressure increases due to a fuel injection rate decrease;

an intersection timing computing means for computing an intersection timing at which a first line expressed by the falling-modeling function and a second line expressed by the rising-modeling function intersect with each other, an intersection pressure computing means for computing an intersection pressure at which a first line expressed by the falling-modeling function and a second line expressed by the rising-modeling function intersect with each other;

a reference pressure computing means for computing a reference pressure based on a fuel pressure right before the falling waveform is generated;

a determination means for determining whether a pressure difference between the reference pressure and the intersection pressure is smaller than or equal to a specified value; and a changing point computing means for computing a maximum-fuel-injection-rate-reach timing at which an output of the falling-modeling function is the specified value and a fuel-injection-rate-decrease-start timing at which an output of the rising-modeling function is the specified value in a case that the difference between the reference pressure and the intersection pressure is smaller than or equal to the specified value.

2. A fuel injection detecting device according to claim 1, wherein the specified value varies according to the reference pressure.

3. A fuel injection detecting device according to claim 1, wherein the reference pressure computing means defines a specified period including a fuel-injection-start timing and sets an average fuel pressure during the specified period as the reference pressure.

4. A fuel injection detecting device according to claim 1, wherein the fuel injection system performs a multi-stage fuel injection during one combustion cycle, the reference pressure computing means computes the reference pressure with respect to a first fuel injection, and the changing point computing means computes the changing timing of a second and successive fuel injection based on the changing timing which is computed with respect to a first fuel injection.

5. A fuel injection detecting device according to claim 4, wherein the changing point computing means subtracts a pressure drop depending on a fuel injection amount of n-th ($n \geqq 2$) fuel injection from the reference pressure computed with respect to (n−1)th fuel injection, and the subtracted reference pressure is used as a new reference pressure for computing the changing timing of n-th fuel injection.

6. A fuel injection detecting device according to claim 5, wherein the maximum fuel injection rate computing means computes the reference pressure of n-th fuel injection based on the reference pressure of the first fuel injection.

7. A fuel injection detecting device according to claim 1, wherein the fuel injector includes:

a high-pressure passage introducing the fuel toward the injection port;

a needle valve for opening/closing the injection port;

a backpressure chamber receiving the fuel from the high-pressure passage so as to apply a backpressure to the needle valve; and a control valve for controlling the backpressure by adjusting a fuel leak amount from the backpressure chamber, and the reference pressure computing means computes the reference pressure based on a second fuel pressure drop generated during a time period from when the control valve is opened until when the needle valve is opened.

8. A fuel injection detecting device according to claim 1, wherein the falling-modeling means models the falling waveform by a straight line model, and the changing point computing means computes the changing point based on the straight line model.

9. A fuel injection detecting device according to claim 8, wherein the falling-modeling means defines a tangent line at a specified point on the falling waveform as the straight line model.

10. A fuel injection detecting device according to claim 9, wherein the falling-modeling means defines a point at which a differential value of the falling waveform is minimum as the specified point.

11. A fuel injection detecting device according to claim 8, wherein the falling-modeling means models the rising waveform by a straight line model based on a plurality of specified points on the rising waveform.

12. A fuel injection detecting device according to claim 11, wherein the falling-modeling means defines a straight line passing through the specified points as the straight line model.

13. A fuel injection detecting device according to claim 11, wherein the falling-modeling means defines a straight line as the straight line model, the straight line in which a total distance between the straight line and the specified points is minimum.

14. A fuel injection detecting device according to claim 1, wherein the rising-modeling means models the rising waveform by a straight line model, and the changing point computing means computes the changing point based on the straight line model.

15. A fuel injection detecting device according to claim 14, wherein the rising-modeling means defines a tangent line at a specified point on the rising waveform as the straight line model.

16. A fuel injection detecting device according to claim 15, wherein the rising-modeling means defines a point at which a differential value of the rising waveform is maximum as the specified point.

17. A fuel injection detecting device according to claim 14, wherein the rising-modeling means models the rising waveform by a straight line model based on a plurality of specified points on the rising waveform.

18. A fuel injection detecting device according to claim 17, wherein the rising-modeling means defines a straight line passing through the specified points as the straight line model.

19. A fuel injection detecting device according to claim 17, wherein the rising-modeling means defines a straight line as the straight line model, the straight line in which a total distance between the straight line and the specified points is minimum.

20. A fuel injection detecting device according to claim 1, further comprising:

a fuel-injection-start timing computing means for computing a fuel-injection-start timing based on the falling waveform;

a fuel-injection-end timing computing means for computing a fuel-injection-end timing based on the rising waveform; and a maximum fuel injection rate computing means computes a maximum fuel injection rate based on the falling waveform and the rising waveform.

21. A fuel injection detecting device according to claim 20, further comprising:

an injection rate waveform computing means for computing a waveform of a fuel injection rate based on the fuel-injection-start timing, the fuel-injection-end timing, the maximum fuel injection rate, the fuel-injection-rate-decrease-start timing and the maximum-fuel-injection-rate-reach timing.

22. A fuel injection detecting device according to claim 20, further comprising:

a fuel injection quantity computing means for computing a fuel injection quantity based on based on the fuel-injection-start timing, the fuel-injection-end timing, the maximum fuel injection rate, the fuel-injection-rate-decrease-start timing and the maximum-fuel-injection-rate-reach timing.

23. A fuel injection detecting device according to claim 20, further comprising:

a falling-modeling means for modeling the falling waveform by a falling-modeling function;

a rising-modeling means for modeling the rising waveform by a rising-modeling function, wherein the fuel-injection-start timing computing means computes the fuel-injection start timing based on the falling-modeling function, the fuel-injection-end timing computing means computes the fuel-injection end timing based on the rising-modeling function, and the maximum fuel injection rate computing means computes a maximum fuel injection rate based on the falling-modeling function and the rising-modeling function.

24. A fuel injection detecting device according to claim 23, further comprising:

a reference pressure computing means for computing a reference pressure based on a fuel pressure right before the falling waveform is generated, and an intersection pressure computing means for computing an intersection pressure at which a first line expressed by the falling-modeling function and a second line expressed by the rising-modeling function intersect with each other, wherein the maximum fuel injection rate computing means computes the maximum fuel injection rate such that the maximum fuel injection rate is larger as the intersection pressure is smaller in a case that a pressure difference between the reference pressure and the intersection pressure is lower than or equal to a specified value, and the maximum fuel injection rate computing means computes the maximum fuel injection rate based on the specified value without respect to the intersection pressure in a case that the pressure difference greater than the specified value.

* * * * *